US012678007B2

(12) United States Patent
Wang et al.

(10) Patent No.: US 12,678,007 B2
(45) Date of Patent: Jul. 14, 2026

(54) AUTOMATIC CLEANING DEVICE CONTROL METHOD AND APPARATUS, AND MEDIUM AND ELECTRONIC DEVICE

(71) Applicant: Beijing Roborock Innovation Technology Co., Ltd., Beijing (CN)

(72) Inventors: Kaijing Wang, Beijing (CN); Yang He, Beijing (CN); Lei Wang, Beijing (CN); Zhengtao Hou, Beijing (CN)

(73) Assignee: Beijing Roborock Innovation Technology Co., Ltd., Beijing (CN)

( * ) Notice: Subject to any disclaimer, the term of this patent is extended or adjusted under 35 U.S.C. 154(b) by 342 days.

(21) Appl. No.: 18/264,960

(22) PCT Filed: Feb. 10, 2022

(86) PCT No.: PCT/CN2022/075777
§ 371 (c)(1),
(2) Date: Aug. 10, 2023

(87) PCT Pub. No.: WO2022/171159
PCT Pub. Date: Aug. 18, 2022

(65) Prior Publication Data

US 2024/0115100 A1 Apr. 11, 2024

(30) Foreign Application Priority Data

Feb. 10, 2021 (CN) ..... 202110184703.4
Feb. 10, 2021 (CN) ..... 202110184845.0

(51) Int. Cl.
*A47L 11/40* (2006.01)

(52) U.S. Cl.
CPC ..... *A47L 11/4011* (2013.01); *A47L 11/4061* (2013.01); *A47L 11/4066* (2013.01);
(Continued)

(58) Field of Classification Search
CPC ..... A47L 11/4011; A47L 11/4061; A47L 11/4066; A47L 11/4072; A47L 2201/04; A47L 2201/06
See application file for complete search history.

(56) References Cited

U.S. PATENT DOCUMENTS

2011/0118928 A1 5/2011 Yoo et al.
2012/0125363 A1 5/2012 Kim et al.
(Continued)

FOREIGN PATENT DOCUMENTS

CN 102551591 A 7/2012
CN 105982624 A 10/2016
(Continued)

OTHER PUBLICATIONS

Extended European Search Report for EP Patent Application No. 22752318.0 of Jan. 7, 2025.
(Continued)

*Primary Examiner* — Andrew A Horton
(74) *Attorney, Agent, or Firm* — Perilla Knox & Hildebrandt; Kenneth A. Knox

(57) ABSTRACT

An automatic cleaning device control method, an automatic cleaning device control apparatus, a computer-readable storage medium and an electronic device are provided. The method includes: acquiring first data based on current state data of a walking wheel of the automatic cleaning device and second data based on current state data of a machine body of the automatic cleaning device when the automatic cleaning device performs cleaning; determining, based on the first data and the second data, whether the automatic cleaning device is trapped or not and controlling the automatic cleaning device to enter an accelerated-escape mode in response to that the automatic cleaning device is trapped.

14 Claims, 15 Drawing Sheets

(52) U.S. Cl.
CPC ..... *A47L 11/4072* (2013.01); *A47L 2201/04* (2013.01); *A47L 2201/06* (2013.01)

(56) References Cited

U.S. PATENT DOCUMENTS

| | | | | |
|---|---|---|---|---|
| 2012/0265391 | A1* | 10/2012 | Letsky | G05D 1/0221 701/25 |
| 2016/0103451 | A1 | 4/2016 | Vicenti | |
| 2016/0374527 | A1 | 12/2016 | Yoo et al. | |
| 2017/0215680 | A1 | 8/2017 | Chang | |
| 2017/0273528 | A1* | 9/2017 | Watanabe | A47L 5/22 |
| 2019/0104908 | A1 | 4/2019 | He et al. | |
| 2019/0258262 | A1 | 8/2019 | Vicenti | |
| 2020/0178748 | A1 | 6/2020 | Han et al. | |
| 2020/0293060 | A1 | 9/2020 | Jeong et al. | |

FOREIGN PATENT DOCUMENTS

| | | | |
|---|---|---|---|
| CN | 107092260 | A | 8/2017 |
| CN | 107997691 | A | 5/2018 |
| CN | 108143364 | A | 6/2018 |
| CN | 109864666 | A | 6/2019 |
| CN | 109984685 | A | 7/2019 |
| CN | 110279347 | A | 9/2019 |
| CN | 110772178 | A | 2/2020 |
| CN | 111035327 | A | 4/2020 |
| CN | 111150331 | A | 5/2020 |
| CN | 111248819 | A | 6/2020 |
| CN | 111427357 | A | 7/2020 |
| CN | 111487969 | A | 8/2020 |
| CN | 111660288 | A | 9/2020 |
| CN | 112205937 | A | 1/2021 |
| CN | 113679290 | A | 11/2021 |
| CN | 113693495 | A | 11/2021 |
| JP | 3323772 | B2 | 9/2002 |

OTHER PUBLICATIONS

International Search Report for International Application No. PCT/CN2022/075777 of May 9, 2022.

International Search Report for International Application No. PCT/CN2022/075772 of May 18, 2022.

First Office Action for CN Patent Application No. 202110184845.0 of Mar. 30, 2022.

First Office Action for CN Patent Application No. 202110184703.4 of Mar. 28, 2022.

Extended European Search Report for EP Patent Application No. of Jul. 22, 2025.

Non-Final Office Action for U.S. Appl. No. 18/546,036 Oct. 1, 2025.

* cited by examiner

AUTOMATIC CLEANING DEVICE CONTROL METHOD AND APPARATUS, AND MEDIUM AND ELECTRONIC DEVICE

CROSS-REFERENCE TO RELATED APPLICATION(S)

This application is a national phase application under 35 U.S.C. § 371 of international Application No. PCT/CN2022/075777 filed on Feb. 10, 2022, which claims the benefit of and priority to Chinese Patent Applications No. 202110184703.4 and Chinese Patent Application No. 202110184845.0, both filed on Feb. 10, 2021, the contents of each of which are incorporated by reference in their entireties herein as a part of the present application.

TECHNICAL FIELD

The present disclosure relates to the field of smart homes and, in particular, to a method and apparatus for controlling an automatic cleaning device, a computer-readable storage medium, and an electronic device.

BACKGROUND

In recent years, with the rapid development of computer technologies and artificial intelligence science, intelligent robot technologies have gradually become a hot spot in the field of modern robot research. One of the most practical intelligent robots is a ground sweeping robot, which can automatically clean a ground with certain artificial intelligence.

At present, more and more families have laid carpets, and the ground sweeping robot may easily be blocked and stopped in the process of cleaning these carpets. Especially for long-pile carpets, the ground sweeping robot may even get stuck and cease to function normally.

BRIEF SUMMARY

An Objective of the present disclosure is to provide a method and apparatus for controlling an automatic cleaning device, a computer-readable storage medium, and an electronic device, which can solve at least one of the above technical problems. The specific solutions are described as below.

According to example embodiments of the present disclosure, in a first aspect, the present disclosure provides a method for controlling an automatic cleaning device, including:

acquiring first data based on current state data of a walking wheel of the automatic cleaning device and second data based on current state data of a machine body of the automatic cleaning device when the automatic cleaning device performs cleaning;

determining, based on the first data and the second data, whether the automatic cleaning device is trapped or not; and controlling the automatic cleaning device to enter an accelerated-escape mode in response to that the automatic cleaning device is trapped.

Optionally, determining, based on the first data and the second data, whether the automatic cleaning device is trapped or not includes:

determining, based on a difference between the first data and the second data, whether the automatic cleaning device is trapped or not.

Optionally, the method further includes:

acquiring a theoretical angular velocity of the walking wheel as the first data based on the current state data of the walking wheel of the automatic cleaning device when the automatic cleaning device is in a rotating state;

acquiring an actual angular velocity of the walking wheel as the second data based on the current state data of the machine body of the automatic cleaning device; and in response to that the difference between the first data and the second data is larger than a first threshold and the difference being larger than the first threshold lasts for first preset time, determining that the automatic cleaning device is trapped.

Optionally, the method further includes:

acquiring a theoretical output power of a motor as the first data based on the current state data of the walking wheel of the automatic cleaning device when the automatic cleaning device is in a straight forward movement state;

acquiring an actual output power of the motor as the second data based on the current state data of the machine body of the automatic cleaning device; and in response to that the difference between the first data and the second data is smaller than a second threshold and the difference being smaller than the second threshold lasts for second preset time, determining that the automatic cleaning device is trapped.

Optionally, acquiring the theoretical output power of the motor based on the current data of the walking wheel of the automatic cleaning device includes:

determining the theoretical output power of the motor based on a current travel distance of the walking wheel of the automatic cleaning device.

Optionally, the method further includes:

acquiring a theoretical output power of a motor as the first data based on the current state data of the walking wheel of the automatic cleaning device when the automatic cleaning device encounters an obstacle and is in a backward movement state;

acquiring an actual output power of the motor as the second data based on the current state data of the machine body of the automatic cleaning device; and in response to that a difference between the first data and the second data is smaller than a third threshold and the difference being smaller than the third threshold lasts for third preset time, and electric current of a main brush of the automatic cleaning device exceeds a fourth threshold and the electric current exceeding the fourth threshold lasts for fourth preset time, determining that the automatic cleaning device is trapped.

Optionally, the accelerated-escape mode includes controlling the automatic cleaning device to perform instantaneous acceleration after deceleration.

Optionally, the method further includes:

determining, based on a result of the instantaneous acceleration after deceleration, whether the automatic cleaning device is located on a misjudgment-prone medium for which a misjudgment is prone to occur; and turning off the accelerated-escape mode when the automatic cleaning device is located on the misjudgment-prone medium, in response to that it is determined that the automatic cleaning device is located on the misjudgment-prone medium.

Optionally, determining, based on the result of the instantaneous acceleration after deceleration, whether the automatic cleaning device is located on the misjudgment-prone medium includes:

in response to that a change peak of an accelerometer on the automatic cleaning device exceeds a threshold after the instantaneous acceleration after deceleration, determining that the automatic cleaning device is located on the misjudgment-prone medium.

Optionally, acquiring the first data based on the current state data of the walking wheel of the automatic cleaning device includes:

acquiring the first data in a current state of the walking wheel based on data of a walking wheel sensor of the automatic cleaning device.

Optionally, acquiring the second data based on the current state at a of the machine: body of the automatic cleaning device includes:

acquiring the current state data of the machine body based on a state sensor on the automatic cleaning device, and acquiring the second data based on the current state data of the machine body.

Optionally, the state sensor includes a gyroscope, a motor power sensor, a cliff sensor, or a touch sensor.

In a second aspect, the present disclosure provides an apparatus for controlling an automatic cleaning device, including:

a data acquisition module configured to acquire first data based on current state data of a walking wheel of the automatic cleaning device and second data based on current state data of a machine body of the automatic cleaning device when the automatic cleaning device performs cleaning;

a state determination module configured to determine, based on the first data and the second data, whether the automatic cleaning device is trapped or not; and an escape control module configured to control the automatic cleaning device to enter an accelerated-escape mode in response to that the automatic cleaning device is trapped.

In a third aspect, the present disclosure provides a computer-readable storage medium, on which a computer program is stored. The computer program, when executed by a processor, implements the method for controlling the automatic cleaning device described above.

In a fourth aspect, the present disclosure provides an electronic device, including:

a processor; and a memory configured to store an instruction executable by the processor, wherein the processor is configured to implement, by executing the executable instruction, the method for control ling the automatic cleaning device described above.

Compared with the related art, in the method for controlling the automatic cleaning device according to the exemplary embodiments of the present disclosure, during cleaning of the automatic cleaning device, it can be determined that the automatic cleaning device is trapped if the first data acquired based on the current state data of the walking wheel is different from the second data acquired based on the current state data of the machine body. At this time, the accelerated-escape mode may help the automatic cleaning device extricate itself, so that the probability that the automatic cleaning device gets stuck is reduced.

In a fifth aspect, the present disclosure provides a cleaning method of an automatic cleaning device. The method relates to a dual-area cleaning mode for cleaning a first surface medium area and a second surface medium area, and includes:

after the automatic cleaning device enters the dual-area cleaning mode, determining whether the second surface medium area exists or not based on a stored map in the automatic cleaning device;

cleaning the second surface medium area in response to that the second surface medium area exists;

marking the second surface medium area as a cleaned area after the cleaning of the second surface medium area is completed, determining whether a next second surface medium area exists or not, and cleaning the next second surface medium area in response to that the next second surface medium area exists until all the second surface medium areas are completely cleaned; and controlling the automatic cleaning device to clean the first surface medium area.

In an exemplary embodiment, determining whether the second surface medium area exists or not based on the stored map in the automatic cleaning device includes:

determining whether the stored map has the second surface medium area or not; and in response to that the stored map has the second surface medium area, controlling the automatic cleaning device to enter a position of the second surface medium area recorded in the stored map, and detecting whether the second surface medium area exists or not.

In an exemplary embodiment, in response to that the second surface medium area is not detected, removing the second surface medium area from the stored map to update the stored map.

In an exemplary embodiment, during controlling of the automatic cleaning device to clean the first surface medium area, the method ti includes:

detecting whether an uncleaned second surface medium area still exists or not;

controlling the automatic cleaning device to clean the uncleaned second surface medium area in response to that the uncleaned second surface medium area exists and storing the uncleaned second surface medium area in the stored map; and after all the uncleaned second surface medium areas are completely cleaned, controlling the automatic cleaning device to continue cleaning the first surface medium area until the first surface medium area is completely cleaned.

In an exemplary embodiment, the method further includes:

duffing cleaning of the second surface medium area, ignoring block limitation and controlling the cleaning robot to clean the entire second surface medium area in response to that the second surface medium area is a cross-block area.

In an exemplary embodiment, before the automatic cleaning device enters the dual-area cleaning mode, the method further includes:

controlling the automatic cleaning device to enter an along-wall cleaning mode;

in response to that the second surface medium area is detected during along-wall cleaning of the automatic cleaning device, ignoring the second surface medium area and controlling the automatic cleaning device to continue with the along-wall cleaning until the along-wall cleaning is finished and the along-wall cleaning mode is exited; and controlling the automatic cleaning device to enter the dual-area cleaning mode.

In an exemplary embodiment, during the along-wall cleaning, the detected second surface medium area is marked, and whether the second surface medium area exists in the stored map is determined; and In response to that the second surface medium area does not exist in the stored map, the second surface medium area is stored in the stored map.

In an exemplary embodiment, cleaning the second surface medium area includes:

cleaning a boundary area of the second surface medium area within the second surface medium area; and cleaning a remaining area of the second surface medium area after cleaning the boundary area is completed.

In a sixth aspect, the present disclosure provides a cleaning apparatus of an automatic cleaning device. The apparatus relates to a dual-area cleaning mode for cleaning a first surface medium area and a second surface medium area, and includes:

an area determination module configured to, after the automatic cleaning device enters the dual-area cleaning mode, determine whether the second surface medium area exists or not based on a stored map in the automatic cleaning device;

a first cleaning control module configured to clean the second surface medium area in response to that the second surface medium area exists, mark the second surface medium area as a cleaned area after the cleaning of the second surface medium area is completed, determine whether a next second surface medium area exists or not, and clean the next second surface medium area in response to that the next second surface medium area exists until all the second surface medium areas are completely cleaned; and a second cleaning control module configured to control the automatic cleaning device to clean the first surface medium area.

In a seventh aspect, the present disclosure provides a computer-readable storage medium, on which a computer program is stored. The computer program, when executed by a processor, implements the cleaning method of the automatic cleaning device according to the fifth aspect or any exemplary embodiment.

In an eighth aspect, the present disclosure provides an electronic device, including:

a processor; and a memory configured to store an instruction executable by the processor, wherein the processor is configured to execute, by executing the executable instruction, the cleaning method of the automatic cleaning device according to the fifth aspect or any exemplary embodiment.

Compared with related art, in the cleaning method of the automatic cleaning device according to the exemplary embodiments of the present disclosure, the automatic cleaning device can be controlled to dean a second surface medium areas first when the cleaning of the automatic cleaning device includes the cleaning of the first surface medium area and the second surface medium areas and the first surface medium area is cleaned after all second surface medium areas are completely cleaned, so that the number of times that the automatic cleaning device controls a wet cleaning module to rise up and lower down is reduced, the cleaning efficiency is improved and the service life of the automatic cleaning device is prolonged.

BRIEF DESCRIPTION OF THE DRAWINGS

The accompanying drawings here, which are incorporated in the description and constitute a part of the description, show embodiments conforming to the present disclosure, and are used to explain the principles of the present disclosure together with the description. Apparently, the accompanying drawings in the following description are only some embodiments of the present disclosure, and for those of ordinary skill in the art, other drawings may also be Obtained from these accompanying drawings without creative efforts. In the accompanying drawings.

DETAILED DESCRIPTION

Figure 1:
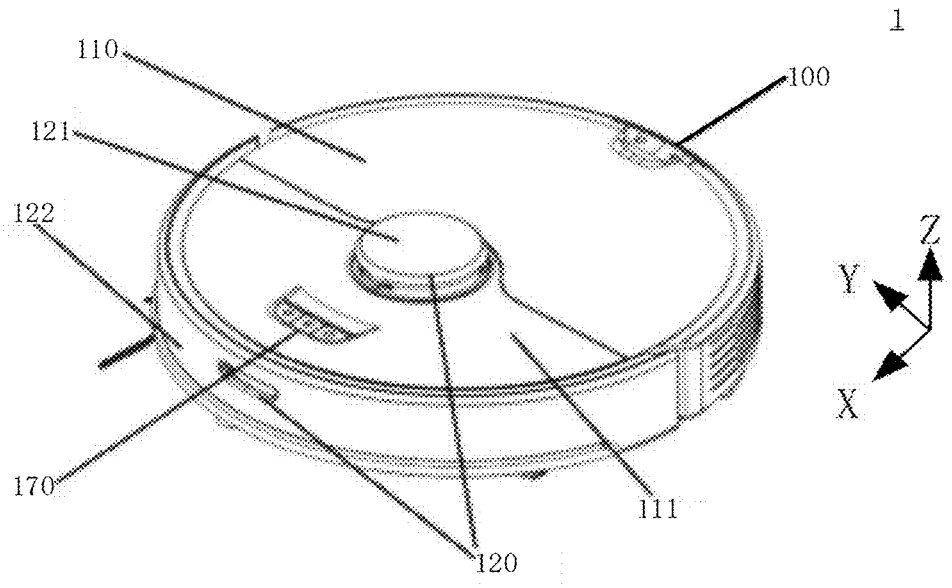
FIG. 1 is an oblique view of an automatic cleaning device according to an embodiment of the present disclosure.

To make the objectives, technical solutions, and advantages of the present disclosure more clear, the present disclosure will be further described in detail below with reference to the accompanying drawings. It is understood that the described embodiments are only some, but not all, of the embodiments of the present disclosure. All other embodiments obtained by those of ordinary skill in the art without creative efforts based on the embodiments in the present disclosure are within the protection scope of the present disclosure.

The terms used in the embodiments of the present disclosure are for the purpose of describing particular embodiments only and are not intended to limit the present disclosure. The singular forms "a/an", "said", and "the" used in the embodiments of the present disclosure and the appended claims are intended to include the plural forms as well, unless otherwise indicated clearly in the context. The term "a plurality of" generally includes at least two.

It is to be understood that the term "and/or" used herein only describes an association relationship between associated objects, and indicates that there may be three kinds of relationships. For example, A and/or B may indicate three cases: A exists alone, A and B exist at the same time, and B exists alone. In addition, the character "/" herein generally indicates an "or" relationship between the contextual objects.

It is to be understood that, although the terms first, second, third, etc. may be used to describe objects in the embodiments of the present disclosure, these terms should not be construed as constituting limitations on the present disclosure. These terms are only used to distinguish Objects. For example, "first . . . " may also be referred to as "second . . . " without departing from the scope of the embodiments of the present disclosure. Similarly, "second . . . " may also be referred to as "first . . . ".

Depending on the context, the words "if" and "on condition that" as used herein may be interpreted as "in the case that . . . " or "when . . . " or "in response to determining" or "in response to detecting". Similarly, depending on the context, the phrases "if it is determined that" or "if it is detected that (the stated condition or event)" may be interpreted as "when it is determined that" or "in response to determining that" or "when it is detected that (the stated condition or event)" or "in response to detecting (the stated condition or event)".

It should also be noted that the terms "includes/include/including", "comprises/comprise/comprising," or any other variants thereof are intended to cover the nonexclusive inclusion, so that the commodities or devices including a series of elements not only include those elements, but also include other unclearly listed elements, or also include the inherent elements of such commodities or devices. Without more limitations, the element defined by the phrase "including a . . . " does not exclude the existence of other same elements in the commodity or device that includes such element.

Figure 2:
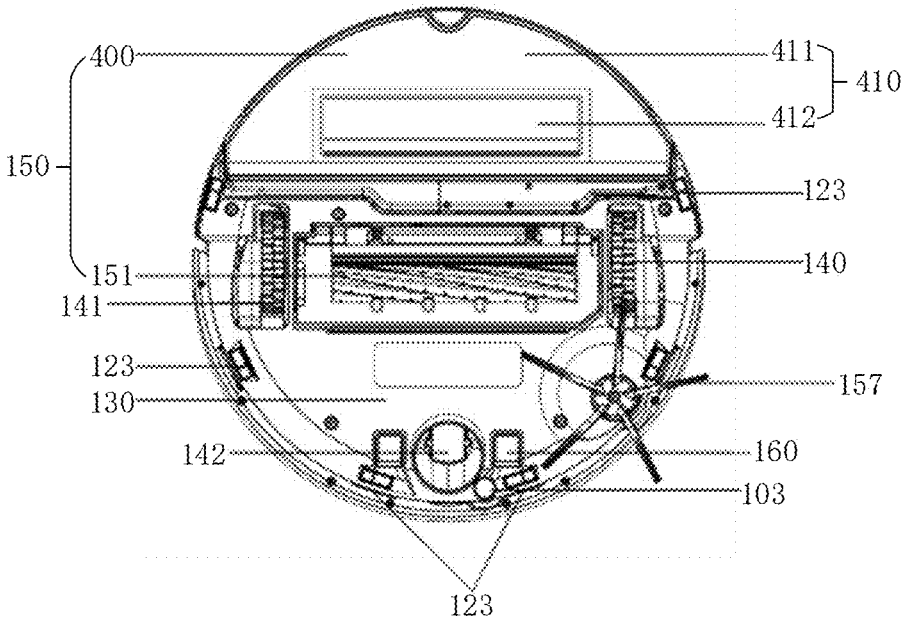
FIG. 2 is a schematic diagram of a bottom structure of an automatic cleaning device according to an embodiment of the present disclosure.

FIGS. 1 and 2 are schematic structural diagrams of an automatic cleaning device according to an exemplary embodiment. As shown in FIGS. 1 and 2, the automatic cleaning device may be a vacuum ground sucking robot, or may be a ground mopping/brushing robot, or may be a window climbing robot, or the like. The automatic cleaning device may include a mobile platform 100, a perception system 120, a control system 130, a driving system 140, a cleaning module 150, an energy system 160, and a human-computer interaction system 170.

The mobile platform 100 may be configured to move automatically along a target direction on an operating surface. The operating surface may be a surface to be cleaned by the automatic cleaning device. In some embodiments, the automatic cleaning device may be a ground mopping robot, and thus the automatic cleaning device operates on a ground, and the ground is the operating surface. The automatic cleaning device may also be a window cleaning robot, and thus the automatic cleaning device operates on an outer surface of glass of a building, and the glass is the operating surface. The automatic cleaning device may also be a pipe cleaning robot, and thus the automatic cleaning device operates on an inner surface of a pipe, and the inner surface of the pipe is the operating surface. For the purposes of illustration only, the following description in the present application takes a ground mopping robot as an example.

In some embodiments, the mobile platform 100 may be an autonomous mobile platform or a non-autonomous mobile platform. The autonomous mobile platform refers to that the mobile platform 100 itself can automatically and adaptively make an operational decision based on an unexpected environmental input; and the non-autonomous mobile platform itself cannot adaptively make an operational decision based on an unexpected environmental input, but can execute a given procedure or operate according to a certain logic. Correspondingly, when the mobile platform 100 is the autonomous mobile platform, the target direction may be determined autonomously by the automatic cleaning device; and when the mobile platform 100 is the non-autonomous mobile platform, the target direction may be set by a system or may be set manually. When the mobile platform 100 is the autonomous mobile platform, the mobile platform 100 includes a forward portion 111 and a rearward portion 110.

The perception system 120 includes a position determining device 121 located on the mobile platform 100, a buffer 122 located in the forward portion 111 of the mobile platform 100, cliff sensors 123, and sensing devices such as an ultrasonic sensor (not shown), an infrared sensor (not shown), a magnetometer (not shown), an accelerometer (not shown), a gyroscope (not shown), or an odometer (not shown), or the like located at a bottom of the mobile platform 100, for providing various position information and motion state information of the automatic cleaning device to the control system 130.

In order to describe behaviors of the automatic cleaning device more clearly, directions are defined as follows. The automatic cleaning device may travel on the ground by various combinations of movements relative to the following three mutually perpendicular axes defined by the mobile platform 100, i.e., a transversal axis X, a front and rear axis Y, and a center vertical axis Z. A forward driving direction along the front and rear axis Y is designated as "forward", and a rearward driving direction along the front and rear axis Y is designated as "rearward". The transversal axis X is substantially along a direction of an axis center defined by a center point of a driving wheel assembly 141 extending between a right wheel and a left wheel of the automatic cleaning device. The automatic cleaning device may rotate around the X axis. It is referred to as "pitch up" when the forward portion of the automatic cleaning device is tilted upward and the rearward portion of the automatic cleaning device is tilted downward, and it is referred to as "pitch down" when the forward portion of the automatic cleaning device is tilted downward and the rearward portion thereof is tilted upward. In addition, the automatic cleaning device may rotate around the Z axis. In a forward direction of the automatic cleaning device, it is referred to as "turn right" when the automatic cleaning device is tilted to the right of the Y axis, and it is referred to as "turn left" when the automatic cleaning device is tilted to the left of the Y axis.

As shown in FIG. 2, cliff sensors 123 are provided at the bottom of the mobile platform 100 and in front and rear of the driving wheel assembly 141, respectively. The cliff sensors 123 are used for preventing the automatic cleaning device from falling off when the automatic cleaning device retreats, so as to avoid a damage to the automatic cleaning device. The aforementioned "front" refers to a side same as a travelling direction of the automatic cleaning device, and the aforementioned "rear" refers to a side opposite to the travelling direction of the automatic cleaning device.

The position determining device 121 includes, but is not limited to, a camera or a laser distance sensor (LDS).

Various components in the perception system 120 may operate independently, or operate together to achieve a target function more accurately. The surface to be cleaned is identified by the cliff sensors 123 and the ultrasonic sensor to determine physical properties of the surface to be cleaned, including a surface medium, a degree of cleanliness, and the like, and determination may be made more accurately in combination with the camera, the LDS, or the like.

For example, the ultrasonic sensor may determine whether the surface to be cleaned is a carpet. If the ultrasonic sensor determines that the surface to be cleaned is made of a carpet material, the control system 130 controls the automatic cleaning device to perform cleaning in a carpet mode.

The forward portion 111 of the mobile platform 100 is provided with the buffer 122. During cleaning, when the driving wheel assembly 141 propels the automatic cleaning device to travel on the ground, the buffer 122 detects one or more events (or objects) in a travelling path of the automatic cleaning device via a sensor system, e.g., an infrared sensor, and the automatic cleaning device may control the driving wheel assembly 141 based on the event (or object), such as obstacle or wall, detected by the buffer 122 to cause the automatic cleaning device to respond to the event (or object), for example, to move away from the obstacle.

The control system 130 is disposed on a main circuit board in the mobile platform 100, and includes a computing processor such as a central processing unit or an application processor, that communicates with a non-transitory memory such as a hard disk, flash memory, or a random-access memory. The computing processor thus can include a hardware processor. The application processor is configured to receive environmental information sensed by the plurality of sensors and transmitted from the perception system 120, to draw a simultaneous map of an environment where the automatic cleaning device is located using a positioning algorithm e.g., simultaneous localization and mapping (SLAM), based on obstacle information fed back by the LDS, and to autonomously determine a travelling path based on the environmental information and the environmental map, and, then, to control the driving system 140 to perform operations, such as travelling forward, travelling backward, and/or steering based on the autonomously determined travelling path. Further, the control system 130 may also determine whether to activate the cleaning module 150 to perform a cleaning operation based on the environmental information and the environmental map.

Specifically, the control system 130 may, based on distance information or speed information which are fed back by the buffer 122, the cliff sensors 123, and the sensing devices such as the ultrasonic sensor, the infrared sensor, the magnetometer, the accelerometer, the gyroscope, or the odometer, comprehensively determine a current operation state of the ground sweeping robot, such as crossing a doorsill, getting on a carpet, locating at an edge of a cliff, being stuck from above or below, having a full dust box, or being picked up. The control system 130 may also give specific next-step action strategies for different situations, so that the operation of the automatic cleaning device is more in line with requirements of an owner and provides better user experience. Further, the control system can plan the most efficient and reasonable cleaning path and cleaning mode based on the simultaneous map drawn by the SLAM, thereby greatly improving the cleaning efficiency of the automatic cleaning device.

Figure 3:
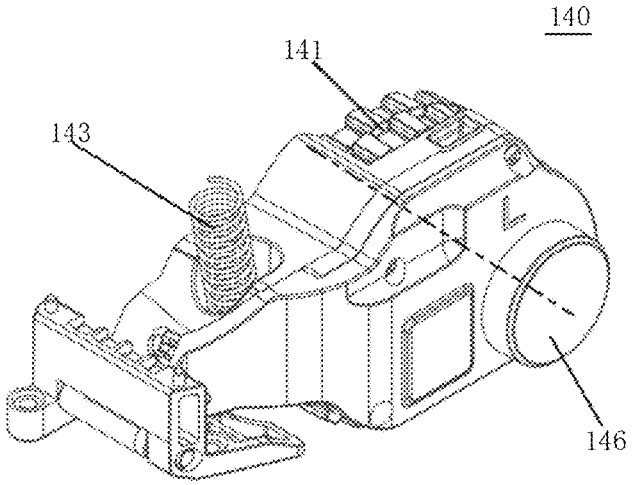
FIG. 3 is an oblique view of a driving wheel assembly on a side according to an embodiment of the present disclosure.
Figure 4:
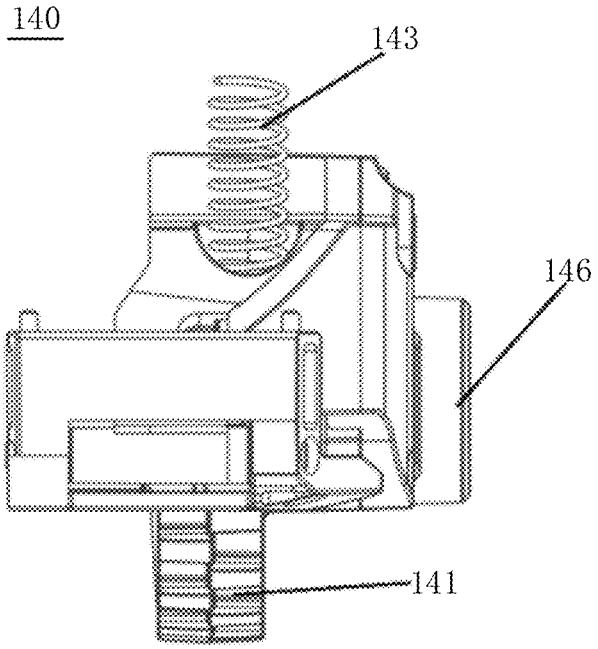
FIG. 4 is a front view of the driving wheel component on a side according to an embodiment of the present disclosure.

The driving system 140 may execute a driving command based on specific distance and angle information, such as x, y, and θ components, to manipulate the automatic cleaning device to travel across the ground. FIGS. 3 and 4 show an oblique view and a front view of a driving wheel assembly 141 on a side according to an embodiment of the present disclosure, respectively. As shown in the figures, the driving system 140 includes the driving wheel assembly 141, and may control a left wheel and a right wheel simultaneously. In order to control the motion of the automatic cleaning device more precisely, the driving system 140 optionally includes a left driving wheel assembly and a right driving wheel assembly. The left driving wheel assembly and the right driving wheel assembly are arranged symmetrically along a transversal axis defined by the mobile platform 100. The driving wheel assembly includes a housing and a connection frame. A driving motor 146 is arranged in the driving wheel assembly. The driving motor 146 is located outside the driving wheel assembly 141, an axis center of the driving motor 146 is located within a sectional projection of the driving wheel assembly, and the driving wheel assembly 141 may also be connected to a circuit for measuring a driving current and the odometer.

In order for the automatic cleaning device to move on the ground more stably or have a stronger movement ability, the automatic cleaning device may include one or more steeling assemblies 142. One of the steering assemblies 142 may be a driven wheel or a driving wheel, and structurally includes but is not limited to a universal wheel. The steering assembly 142 may be located in front of the driving wheel assembly 141.

The driving motor 146 provides power for rotation of the driving wheel assembly 141 and/or the steering assembly 142.

The driving wheel assembly 141 may be detachably connected to the mobile platform 100 to facilitate assembly, disassembly, and maintenance. The driving wheel may have an offset drop suspension system which is movably fastened, e.g., rotatably attached, to the mobile platform 100 of the automatic cleaning device, and maintain contact and traction with the ground by an elastic element 143 such as a tension spring or a compression spring with a certain grounding force. Meanwhile, the cleaning module 150 of the automatic cleaning device is also in contact with the surface to be cleaned with a certain pressure.

The energy system 160 includes a rechargeable battery, such as a nickel-hydride battery and a lithium battery. The rechargeable battery may be connected with a charging control circuit, a battery pack charging temperature detecting circuit and a battery undervoltage monitoring circuit, where the charging control circuit, the battery pack charging temperature detecting circuit, and the battery undervoltage monitoring circuit are then connected to a single-chip microcomputer control circuit. A host is connected to a charging pile through a charging electrode disposed on a side of or below a machine body for charging.

The human-computer interaction system 170 includes buttons that are on a panel of the host and used by a user to select functions. The human-computer interaction system 170 may further include a display screen and/or an indicator light and/or a horn. The display screen, the indicator light, or the horn presents a current state or function item of the automatic cleaning device to the user. The human-computer interaction system 170 may further include a mobile client program. For a route navigation type cleaning apparatus, a mobile client may present a map of the environment where the apparatus is located and a position of the apparatus to the user, which may provide richer and more user-friendly function items to the user.

The cleaning module 150 may include a dry cleaning module 151 and/or a wet cleaning module 400.

As shown in FIGS. 5-8, the dry cleaning module 151 includes a rolling brush, a dust box, a blower, and an air outlet. The rolling brush, having a certain interference with the ground, sweeps up garbage on the ground and rolls up the garbage to the front of a dust suction inlet between the rolling brush and the dust box, and then the garbage is sucked into the dust box by air having a suction force, which is generated by the blower and passes through the dust box. A dust removal capacity of the ground sweeping robot may be characterized by a dust pickup efficiency (DPU) of the garbage. The DPU is affected by a structure and material of the rolling brush, by a utilization rate of the air in an air channel formed by the dust suction inlet, the dust box, the blower, the air outlet and connecting components between the four, and by a type and power of the blower, which is a complex systematic design problem. Compared to an ordinary plug-in vacuum cleaner, the improvement of the dust removal capacity is more meaningful for an automatic cleaning device with limited energy because the improvement of the dust removal capacity directly and effectively reduces requirements for energy. For example, a previous cleaning apparatus that may clean 80 square meters of the ground on a single charge may be evolved to clean 180 square meters or more on a single charge. Furthermore, the service life of the battery with the reduced number of charging times will also be greatly increased, so that the frequency of replacing the battery by the user will also be decreased. More intuitively and importantly, the improvement of the dust removal capacity is the most apparent and important user experience, as the user will directly come to a conclusion of whether the thorough cleaning is achieved. The dry cleaning module may further include a side brush 157 having a rotary shaft angled relative to the ground, for moving debris into a region of the rolling brush of the cleaning module 150.

Figure 5:
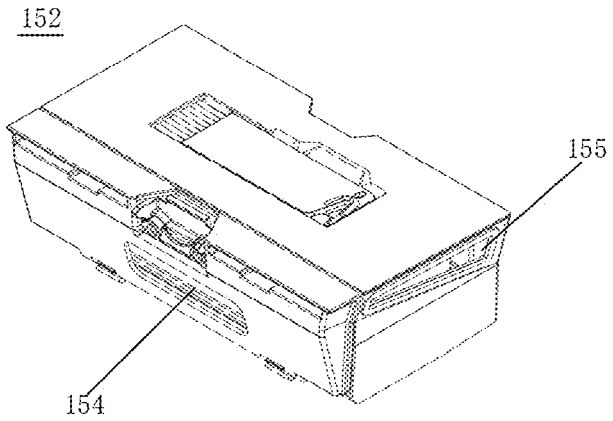
FIG. 5 is an oblique view of a dust box according to an embodiment of the present disclosure.
Figure 6:
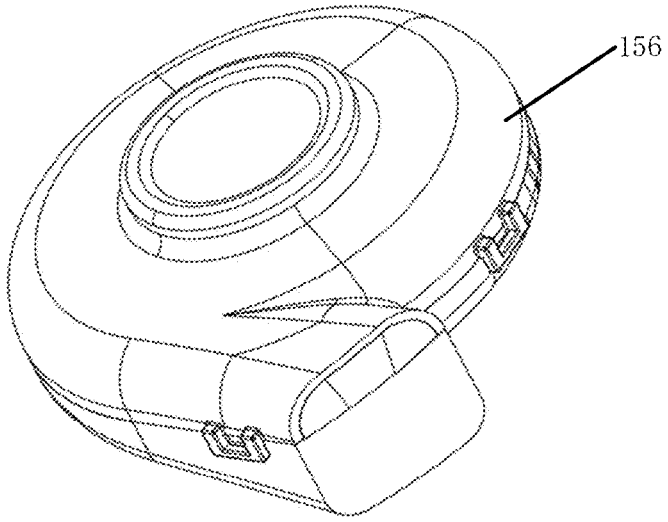
FIG. 6 is an oblique view of a blower according to an embodiment of the present disclosure.
Figure 7:
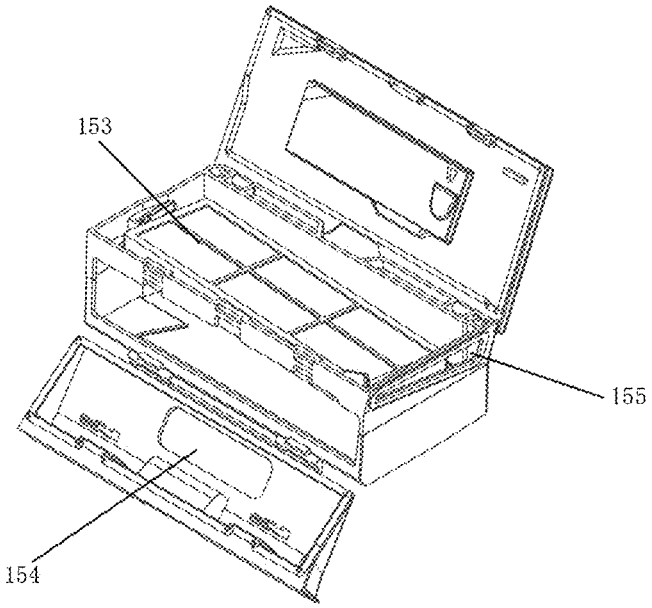
FIG. 7 is a schematic diagram of a dust box in an open state according to an embodiment of the present disclosure.
Figure 8:
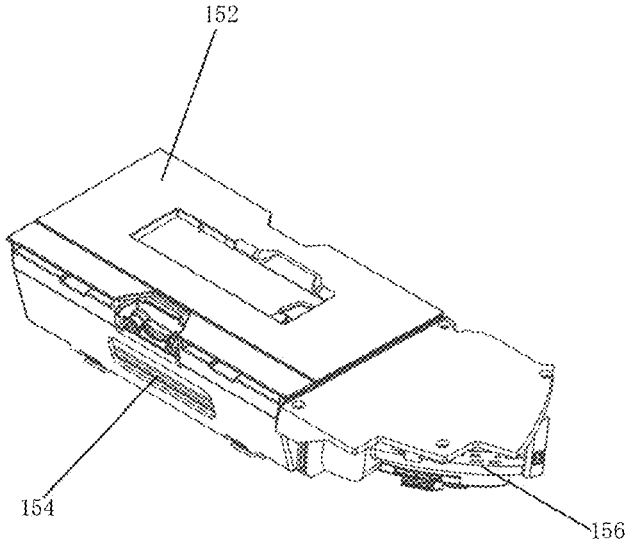
FIG. 8 is a schematic diagram of a dust box and a blower in an assembled state according to an embodiment of the present disclosure.

FIG. 5 is a schematic structural diagram of a dust box 152 in the dry cleaning module, FIG. 6 is a schematic structural diagram of a blower 156 in the dry cleaning module, FIG. 7 is a schematic diagram of the dust box 152 in an open state, and FIG. 8 is a schematic diagram of the dust box and the blower in an assembled state.

The rolling brush, having a certain interference with the ground, sweeps up garbage on the ground and rolls up the garbage to the front of the dust suction inlet 154 between the rolling brush and the dust box 152, and then the garbage is sucked into the dust box 152 by air having a suction force, which is generated by the blower 156 and passes through the dust box 152. The garbage is isolated inside the dust box 152 close to the dust suction inlet 154 by a filter 153, and the filter 153 completely isolates the dust suction inlet from the air outlet, so that the filtered air enters the blower 156 through the air outlet 155.

Typically, the dust suction inlet 154 of the dust box 152 is located in front of the automatic cleaning device, the air outlet 155 is located on a side of the dust box 152, and an air inlet of the blower 156 is docked with the air outlet of the dust box.

A front panel of the dust box 152 may be opened for cleaning the garbage in the dust box 152.

The filter 153 is detachably connected to a machine body of the dust box 152 to facilitate detachment and cleaning of the filter.

Figure 9:
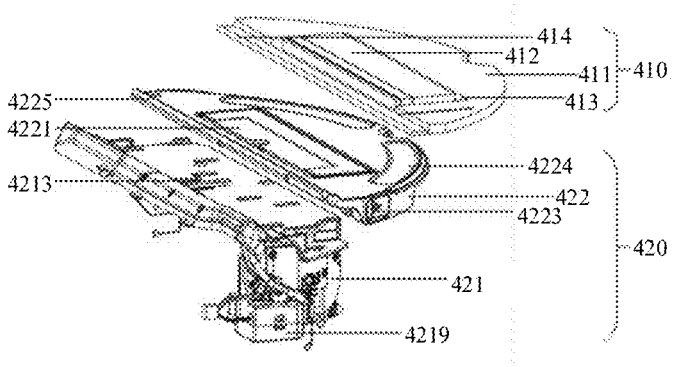
FIG. 9 is an exploded diagram of an automatic cleaning device according to an embodiment of the present disclosure.
Figure 10:
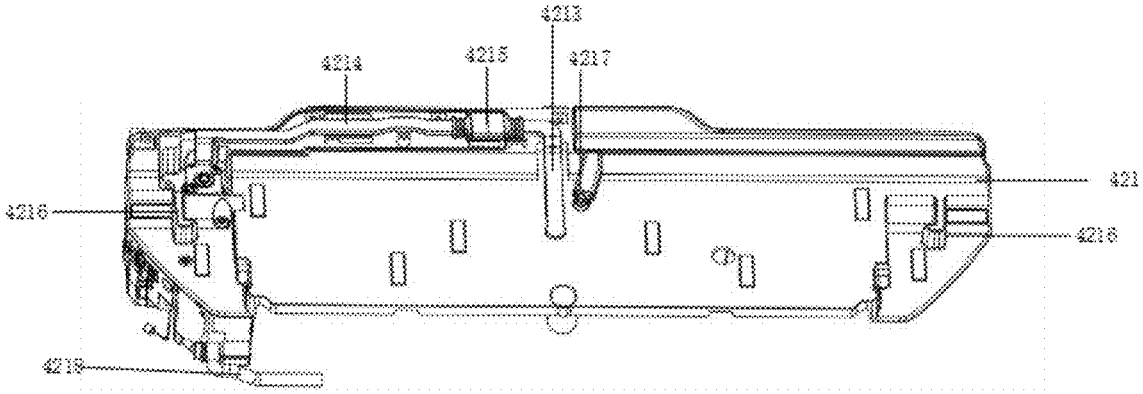
FIG. 10 is a structural diagram of a supporting platform of an automatic cleaning device according to an embodiment of the present disclosure.
Figure 11:
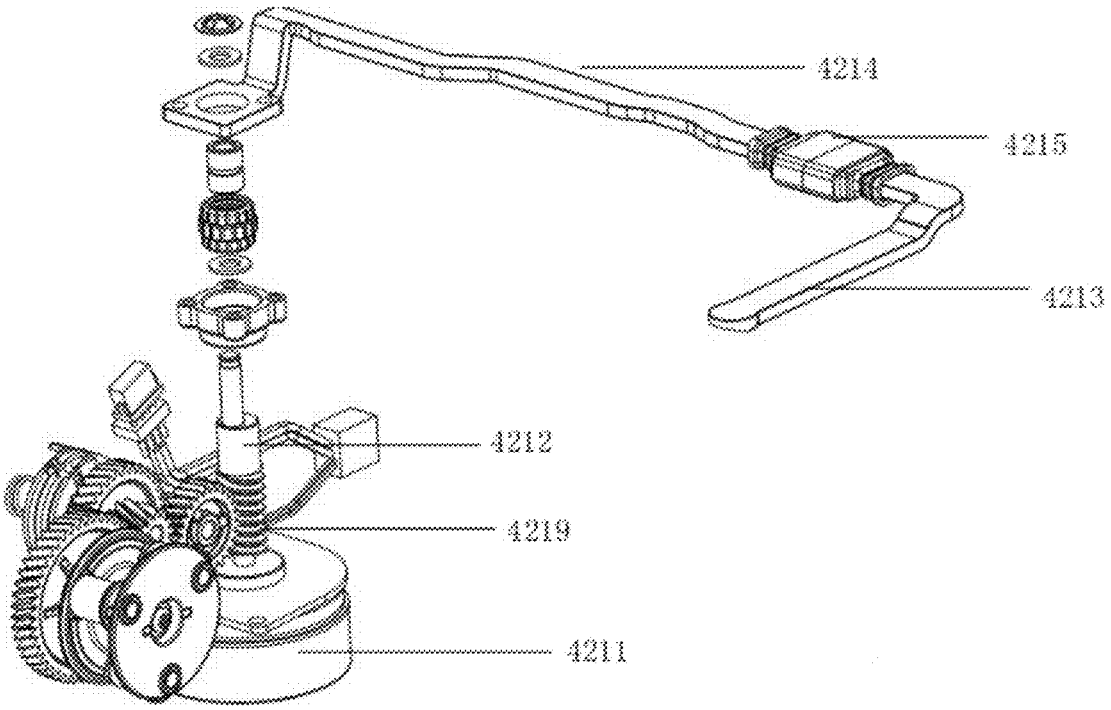
FIG. 11 is a structural diagram of a vibrating member of an automatic cleaning device according to an embodiment of the present disclosure.

As shown in FIGS. 9 to 11, the wet cleaning module 400 according to the present disclosure is configured to clean at least a part of the operating surface by means of wet cleaning. The wet cleaning module 400 includes a cleaning head 410 and a driving unit 420. The cleaning head 410 is used for cleaning at least a part of the operating surface, and the driving unit 420 is used for driving the cleaning head 410 to reciprocate along a target surface, the target surface being a part of the operating surface. The cleaning head 410 reciprocates along a surface to be cleaned, and a surface of the cleaning head 410 in contact with the surface to be cleaned is provided with a cleaning cloth or a cleaning plate, which generates a high-frequency friction with the surface to be cleaned through reciprocating motion, thereby removing stains on the surface to be cleaned. The reciprocating motion may be a repeated motion in any one or more directions within the operating surface, or may be a vibrating motion perpendicular to the operating surface, which is not strictly limited.

As shown in FIG. 9, the driving unit 420 includes a driving platform 421 connected to a bottom surface of the mobile platform 100 for providing a driving force, and a supporting platform 422 detachably connected to the driving platform 421 for supporting the cleaning head 410 and being able to raise and lower under the driving of the driving platform 421.

A raising and lowering module is provided between the cleaning module 150 and the mobile platform 100, so that the cleaning module 150 may be in better contact with the surface to be cleaned, or different cleaning strategies may be used for surfaces to be cleaned made of different materials.

The dry cleaning module 151 may be connected to the mobile platform 100 by a passive raising and lowering module. When the cleaning apparatus encounters an obstacle, the dry cleaning module 151 may pass the obstacle more easily through the raising and lowering module.

The wet cleaning module 400 may be connected to the mobile platform 100 by an active raising and lowering module. When the wet cleaning module 400 does not participate in the operation temporarily, or when a surface to be cleaned cannot be cleaned by the wet cleaning module 400, the wet cleaning module 400 is raised by the active raising and lowering module and separated from the surface to be cleaned, so as to realize the change of cleaning means.

As shown in FIGS. 10 and 11, the driving platform 421 includes: a motor 4211 disposed on a side of the driving platform 421 close to the mobile platform 100 and used for outputting power through a motor output shaft; a driving wheel 4212 connected to the motor output shaft and having an asymmetric structure; and a vibrating member 4213 disposed on a side of the driving platform 421 opposite to the motor 4211 and connected to the driving wheel 4212 to reciprocate under the asymmetrical rotation of the driving wheel 4212.

The driving platform 421 may further include a driving wheel and a gear mechanism. The gear mechanism 235 may connect the motor 4211 and the driving wheel 4212. The motor 4211 may directly drive the driving wheel 4212 to rotate, or may indirectly drive the driving wheel 4212 to rotate through the gear mechanism. The gear mechanism may be one gear, or may be a gear set composed of a plurality of gears.

The motor 4211 simultaneously transmits, through a power transmission device, power to the cleaning head 410, the driving platform 421, the supporting platform 422, a water delivery mechanism, a water tank, and the like. The energy system 160 provides power and energy for the motor 4211 and is entirely controlled by the control system 130. The power transmission device may be a gear drive, a chain drive, a belt drive, or may be a worm gear, or the like.

The motor 4211 has a forward output mode and a reverse output mode. In the forward output mode, the motor 4211 rotates in the forward direction; and in the reverse output mode, the motor 4211 rotates in the reverse direction. In the forward output mode of the motor 4211, the motor 4211 simultaneously drives, through the power transmission device, the cleaning head 410 in the wet cleaning assembly 400 and the water delivery mechanism to move synchronously.

Further, the driving platform 421 further includes a connecting rod 4214 extending along an edge of the driving platform 421 and connecting the driving wheel 4212 and the vibrating member 4213, so that the vibrating member 4213 extends to a preset position. An extension direction of the vibrating member 4213 is perpendicular to the connecting rod 4214.

The motor 4211 is connected to the driving wheel 4212, the vibrating member 4213, the connecting rod 4214 and a vibration buffering device 4215 through the power transmission device. When the wet cleaning assembly 400 is activated, the motor 4211 is started to rotate forward, the motor 4211 drives the connecting rod 4214 through the driving wheel 4212 to reciprocate along the surface of the driving platform 421, and meanwhile, the vibration buffering device 4215 drives the vibrating member 4213 to reciprocate along the surface of the driving platform 421, the vibrating member 4213 drives a cleaning substrate 4221 to reciprocate along the surface of the supporting platform 422, and the cleaning substrate 4221 drives a movable region 412 to reciprocate along the surface to be cleaned. At this time, a clean water pump enables clean water to flow out of a clean water tank and sprinkles the clean water on the cleaning head 410 through a water discharging device 4217, and the cleaning head 410 reciprocates to clean the surface to be cleaned.

The cleaning intensity/efficiency of the automatic cleaning device may also be automatically and dynamically adjusted according to an operation environment of the automatic cleaning device. For example, the automatic cleaning device may achieve dynamic adjustment based on physical information of the surface to be cleaned detected by the perception system 120. For example, the perception system 120 may detect the flatness of the surface to be cleaned, a material of the surface to be cleaned, the existence of oil and dust, and other information, and transmit the information to the control system 130 of the automatic cleaning device. Correspondingly, the control system 130 may instruct the automatic cleaning device to automatically and dynamically adjust a rotational speed of the motor and a transmission ratio of the power transmission device according to the operation environment of the automatic cleaning device, so as to adjust a preset reciprocating period of the reciprocating motion of the cleaning head 410.

For example, when the automatic cleaning device operates on a flat ground, the preset reciprocating period may be automatically and dynamically adjusted to be longer, and a water volume of the water pump may be automatically and dynamically adjusted to be smaller; and when the automatic cleaning device operates on a less flat ground, the preset reciprocating period may be automatically and dynamically adjusted to be shorter, and the water volume of the water pump may be automatically and dynamically adjusted to be larger. This is because it is easier to clean the flat ground than the less flat ground, and thus the reciprocating motion of the cleaning head 410 at a higher speed (i.e., a higher frequency) and larger water volume is needed for cleaning an uneven ground.

For another example, when the automatic cleaning device operates on a table, the preset reciprocating period may be automatically and dynamically adjusted to be longer, and the water volume of the water pump may be automatically and dynamically adjusted to be smaller; and when the automatic cleaning device 100 operates on a ground, the preset reciprocating period may be automatically and dynamically adjusted to be shorter, and the water volume of the water pump may be automatically and dynamically adjusted to be larger. This is because the table has less dust and oil compared to the ground, the material of the table is also easier to clean, and thus the table can be cleaned with fewer number of reciprocating motions of the cleaning head 410 and relatively smaller water volume of the water pump.

The supporting platform 422 includes a cleaning substrate 4221 freely and movably disposed on the supporting platform 422 and reciprocating under the vibration of the vibrating member 4213. Optionally, the cleaning substrate 4221 includes an assembly notch (not shown) disposed at a position in contact with the vibrating member 4213. When the supporting platform 422 is connected to the driving platform 421, the vibrating member 4213 is assembled to the assembly notch, so that the cleaning substrate 4221 may reciprocate synchronously along with the vibrating member 4213.

Figure 12:
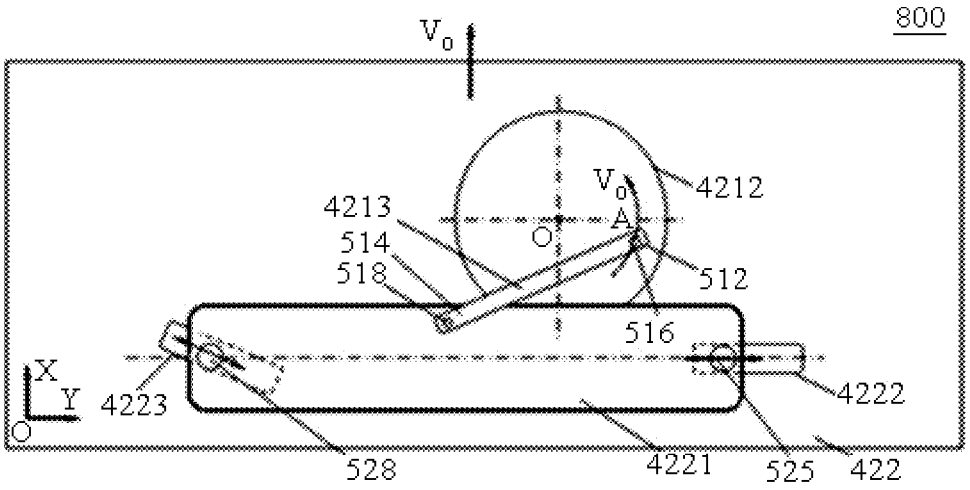
FIG. 12 is a schematic diagram of a cleaning head driving mechanism based on a crank slider mechanism according to another embodiment of the present disclosure.

FIG. 12 shows another cleaning head driving mechanism 800 based on a crank slider mechanism according to a plurality of embodiments of the present disclosure. The driving mechanism 800 may be applied to the driving platform 421. The driving; mechanism 800 includes a driving wheel 4212, a vibrating member 4213, a cleaning substrate 4221, a slot 4222 (a first slot) and a slot 4223 (a second slot).

The slots 4222 and 4223 are formed in the supporting platform 422. Both ends of the cleaning substrate 4221 include a slider 525 (a first slider) and a slider 528 (a second slider), respectively. Each of the sliders 525 and 528 is a protrusion at each of both ends of the cleaning substrate 4221. The slider 525 is inserted into the slot 4222 and may slide along the slot 4222, and the slider 528 is inserted into the slot 4223 and may slide along the slot 4223. In some embodiments, the slot 4222 and the slot 4223 are on the same line. In some embodiments, the slot 4222 and the slot 4223 are not on the same line. In some embodiments, the slot 4222 and the slot 4223 extend along the same direction. In some embodiments, an extension direction of the slot 4222 and an extension direction of the slot 4223 are the same as that of the cleaning substrate 4221. In some embodiments, the extension direction of the slot 4222 and the extension direction of the slot 4223 are different from that of the cleaning substrate 4221. In some embodiments, the extension direction of the slot 4222 is different from that of the slot 4223. For example, as shown in FIG. 12, the extension direction of the slot 4222 is the same as that of the cleaning substrate 4221, and the extension direction of the slot 4223 is at a certain angle with the extension direction of the slot 4222.

The vibrating member 4213 includes a rotation end 512 and a sliding end 514. The rotation end 512 is connected to the driving wheel 4212 through a first pivot 516, and the sliding end 514 is connected to the cleaning substrate 4221 through a second pivot 518.

A rotation center of the driving wheel 4212 is a point O, and a pivoting center of the first pivot 516 is a point A. The point O and the point A do not coincide, and the distance between the point O and the point A is a preset distance d.

When the driving wheel 4212 rotates, the point A also performs a circular rotary motion accordingly. Correspondingly, the rotation end 512 follows the point A to perform a circular rotary motion, and the sliding end 514 drives the cleaning substrate 4221 to perform a sliding motion through the second pivot 518. Correspondingly, the slider 525 of the cleaning substrate 4221 linearly reciprocates along the slot 4222, and the slider 528 linearly reciprocates along the slot 4223. In FIG. 4, a moving speed of the mobile platform 100 is V0, and a moving direction thereof is a target direction. According to some embodiments, when the slot 4223 and the slot 4222 are approximately perpendicular to the direction of the moving speed V0 of the mobile platform 100 respectively, an overall displacement of the cleaning substrate 4221 is substantially perpendicular to the target direction. According to some other embodiments, when any one of the slot 4223 and the slot 4222 forms an angle other than 90 degrees with the target direction, the overall displacement of the cleaning substrate 4221 includes both a component perpendicular to the target direction and a component parallel to the target direction.

Further, a vibration buffering device 4215 is included, which is disposed on the connecting rod 4214 for reducing vibration in a specific direction. In this embodiment, the vibration buffering device 4215 is used for reducing the vibration in a direction of a movement component perpendicular to the target direction of the automatic cleaning device.

Figure 13:
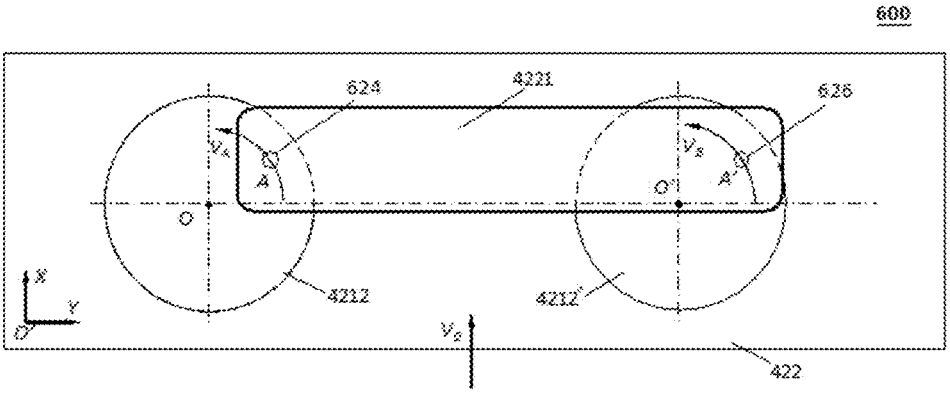
FIG. 13 is a schematic diagram of a cleaning head driving mechanism based on a double-crank mechanism according to another embodiment of the present disclosure.

FIG. 13 shows another cleaning head driving mechanism 600 based on a double-crank mechanism according to a plurality of embodiments of the present invention. The driving mechanism 600 may be applied to the driving platform 421. The driving mechanism 600 includes a driving wheel 4212 (a first driving wheel), a driving wheel 4212' (a second driving wheel) and a cleaning substrate 4221.

The cleaning substrate 4221 has two ends, a first end of the cleaning substrate 4221 is connected to the driving wheel 4212 through a pivot 624 (a first pivot), and a second end of the cleaning substrate 4221 is connected to the driving wheel 4212' through a pivot 626 (a second pivot). A rotation center of the driving wheel 4212 is a point O, and a pivoting center of the pivot 624 is a point A. The point O and the point A do not coincide, and the distance between the point O and the point A is a preset distance d. A rotation center of the driving wheel 236 is a point O', and a pivoting center of the pivot 626 is point A'. The point O' and the point A' do not coincide, and the distance between the point O and the point A' is a preset distance d. In some embodiments, the point A, the point A', the point O, and the point O' are located on the same plane. Therefore, the driving wheel 4212, the driving wheel 4212' and the cleaning substrate 4221 may form a double-crank mechanism (or a parallelogram mechanism), wherein the cleaning substrate 4221 acts as a coupling rod, and the driving wheels 4212 and 4212' act as two cranks.

Further, a vibration buffering device 4215 is included, which is disposed on the connecting rod 4214 for reducing vibration in a specific direction. In this embodiment, the vibration buffering device 4215 is used for reducing the vibration in a direction of a movement component perpendicular to the target direction of the automatic cleaning device.

Figure 14:
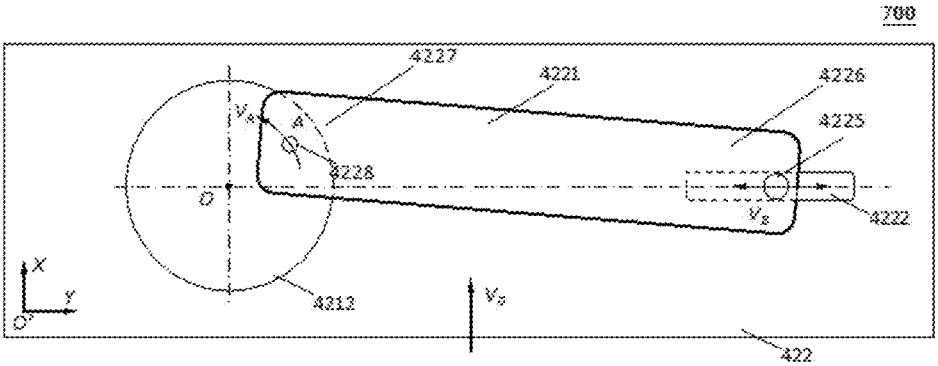
FIG. 14 is a schematic diagram of a cleaning head driving mechanism based on a crank mechanism according to another embodiment of the present disclosure.

FIG. 14 shows a driving mechanism 700 based on a crank slider mechanism according to a plurality of embodiments of the present invention. The driving mechanism 700 may be applied to the driving platform 421. The driving mechanism 700 includes a driving wheel 4212, a cleaning substrate 4221 and a slot 4222.

The slot 4222 is formed in the supporting platform 422. The cleaning substrate 4221 includes a rotation end 4227 and a sliding end 4226. The rotation end 4227 is connected to the driving wheel 4212 through a pivot 4228. A rotation center of the (hiving wheel 4212 is a point O, and a pivoting center of the pivot 4228 of the rotation end is a point A. The point O and the point A do not coincide, and the distance between the point O and the point A is a preset distance d. The sliding end 4226 includes a slider 4225. The slider 4225 is a protrusion on the sliding end 4226. The slider 4225 is inserted into the slot 4222 and may slide along the slot 4222. Therefore, the driving wheel 4212, the cleaning substrate 4221, the slider 4225 and the slot 4222 constitute the crank slider mechanism.

When the driving wheel 4212 rotates, the point A performs a circular rotary motion accordingly. Correspondingly, the rotation end 4227 of the cleaning substrate 4221 follows the point A to perform a circular rotary motion, and the slider 4225 also slides in the slot 4222 and reciprocates linearly. As a result, the cleaning substrate 4221 starts to reciprocate. According to some embodiments, the slot 4222 is approximately perpendicular to a direction of the target direction of the moving speed of the mobile platform. Therefore, the linear motion of the sliding end 4226 includes a component perpendicular to the target direction, and the circular rotation motion of the rotation end 4227 includes both a component perpendicular to the target direction and a component parallel to the target direction.

In FIG. 14, a moving speed of the mobile platform is V0, and a moving direction thereof is a target direction, and the slot 4222 is approximately perpendicular to the target direction. At this time, the reciprocating motion of the cleaning substrate 4221 as a whole includes both a movement component parallel to the target direction of the automatic cleaning device and a movement component perpendicular to the target direction of the automatic cleaning device.

Further, a vibration buffering device 4215 is included. The vibration buffering device 4215 is disposed on the connecting rod 4214 for reducing vibration in a specific direction. In this embodiment, the vibration buffering device 4215 is used for reducing the vibration in a direction of a movement component perpendicular to the target direction of the automatic cleaning device.

Further, the supporting platform 422 further includes an elastic detaching button 4229 disposed on at least one side of the supporting platform 422 for detachably connecting the supporting platform 422 to pawls 4216 of the driving platform 421. At least one assembly region 4224 is disposed on the supporting platform 422 for assembling the cleaning head 410. The assembly region 4224 may be formed of an adhesive material with an adhesive layer.

As shown in FIG. 9, the cleaning head 410 includes a movable region 412 connected to the cleaning substrate 4221 to reciprocate along the surface to be cleaned under the driving of the cleaning substrate 4221. The movable region 412 is disposed at a substantially central position of the cleaning head 410. An adhesive layer is provided on a side of the movable region 412 connected to the cleaning substrate 4221, and the movable region 412 is connected to the cleaning substrate 4221 through the adhesive layer.

Optionally, the cleaning head 410 further includes a fixed region 411 connected to a bottom of the supporting platform 422 through the at least one assembly region 4224. The fixed region 411 cleans at least a part of the operating surface along with the movement of the supporting platform 422.

Further, the cleaning head 410 further includes a flexible connecting portion 413 disposed between the fixed region 411 and the movable region 412 for connecting the fixed region 411 and the movable region 412. The cleaning head 410 further includes a sliding fastener 414 extending along an edge of the cleaning head 410 and detachably mounted at an engagement position 4225 of the supporting platform 422.

As shown in FIG. 9, the cleaning head 410 may be made of a material with certain elasticity, and is fixed to the surface of the supporting platform 422 through the adhesive layer so as to reciprocate. The cleaning head 410 is always in contact with the surface to be cleaned during operation.

The water delivery mechanism includes a water discharging device 4217 that may be directly or indirectly connected to a cleaning liquid outlet of a water tank (not shown), that is, a liquid outlet of the clean water tank. The cleaning liquid may flow to the water discharging device 4217 via the cleaning liquid outlet of the water tank, and may be evenly coated on the surface to be cleaned through the water discharging device. A connecting member (not shown) may be provided on the water discharging device, and the water discharging device is connected to the cleaning liquid outlet of the water tank through the connecting member. The water discharging device is provided with a distribution port which may be a continuous opening or a combination of several discontinuous small openings, and several nozzles may be provided at the distribution port. The cleaning liquid flows to the distribution port via the cleaning liquid outlet of the water tank and the connecting member of the water discharging device, and is evenly coated on the operating surface via the distribution port.

The water delivery mechanism may further include a clean water pump 4219 and/or a clean water pump pipe 4218, The clean water pump 4219 may be communicated with the cleaning liquid outlet of the water tank directly, or communicated with the cleaning liquid outlet of the water tank through the clean water pump pipe 4218.

The clean water pump 4219 may be connected to the connecting member of the water discharging device, and configured to pump the cleaning liquid from the water tank to the water discharging device. The clean water pump may be a gear pump, a vane pump, a plunger pump, a peristaltic pump, or the like.

The water delivery mechanism draws the cleaning liquid out of the clean water tank through the clean water pump 4219 and the clean water pump pipe 4218, and transports the cleaning liquid to the water discharging device. The water discharging device 4217 may be a sprinkler head, a drip hole, a wet cloth, or the like, and may uniformly spread water on the cleaning head so as to wet the cleaning head and the surface to be cleaned. Stains on the wetted surface to be cleaned can be cleaned more easily. In the wet cleaning assembly 400, the power/flow rate of the clean water pump may be adjusted.

By adding the driving unit and the vibration region to the above wet cleaning module, the cleaning head may reciprocate to repeatedly clean the surface to be cleaned. Therefore, in a movement trajectory of the automatic cleaning device, a region may be cleaned several times by the cleaning robot passing the region just one time, thereby greatly enhancing the cleaning effect. The cleaning effect is readily apparent especially for a region with more stains.

Figure 15:
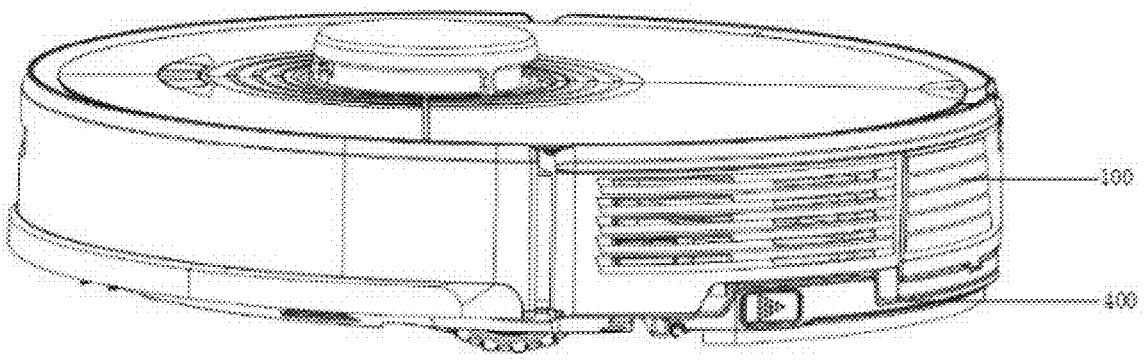
FIG. 15 is a schematic diagram of an automatic cleaning device in a raised state according to an embodiment of the present disclosure.
Figure 16:
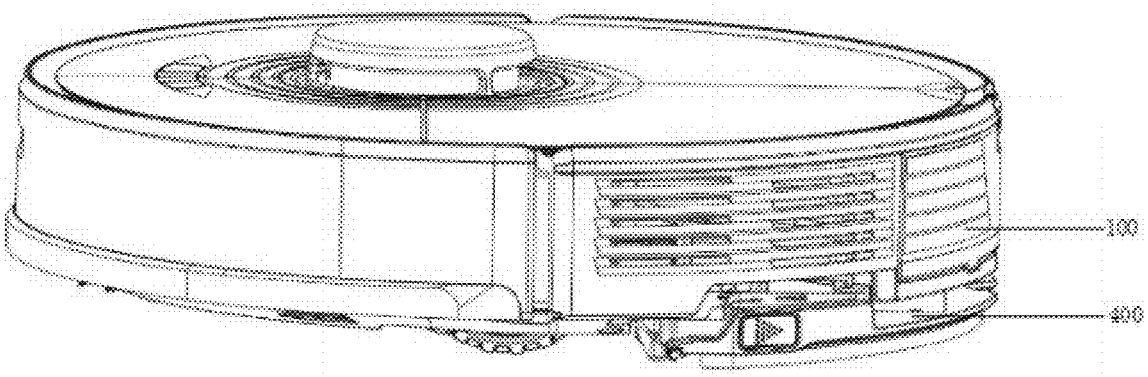
FIG. 16 is a schematic diagram of an automatic cleaning device in a lowered state according to an embodiment of the present disclosure.

According to an example embodiment of the present disclosure, the present disclosure provides an automatic cleaning device which is capable of raising and lowering, including: a mobile platform 100, configured to move automatically on an operating surface; and a wet cleaning module 400, movably connected to the mobile platform 100 through a four-link raising and lowering structure 500, and configured to clean at least a part of the operating surface by means of wet cleaning. The four-link raising and lowering structure 500 is a parallelogram structure for switching the wet cleaning module 400 between a raised state and a lowered state. In the raised state, the wet cleaning module 400 leaves the operating surface, as shown in FIG. 15; and in the lowered state, the wet cleaning module 400 is attached to the operating surface, as shown in FIG. 16.

Figure 17:
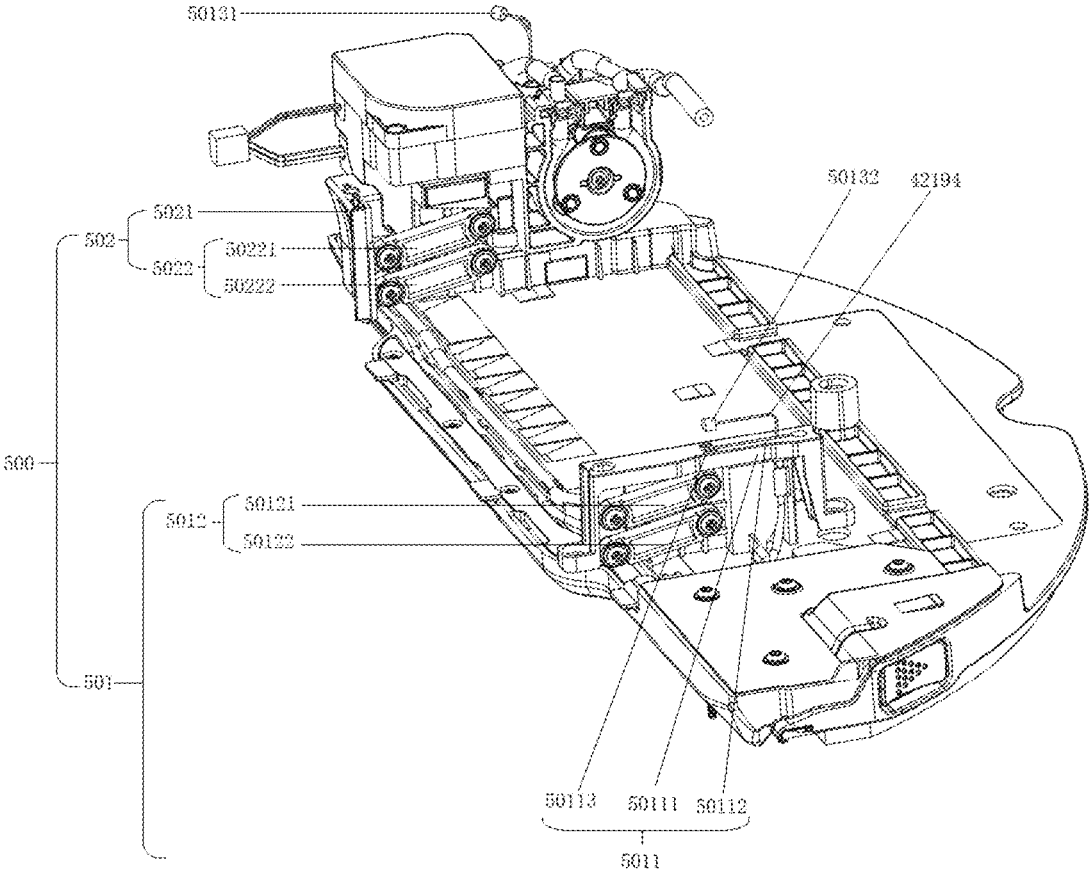
FIG. 17 is a schematic diagram of a four-link raising and lowering structure in a raised state according to an embodiment of the present disclosure.
Figure 18:
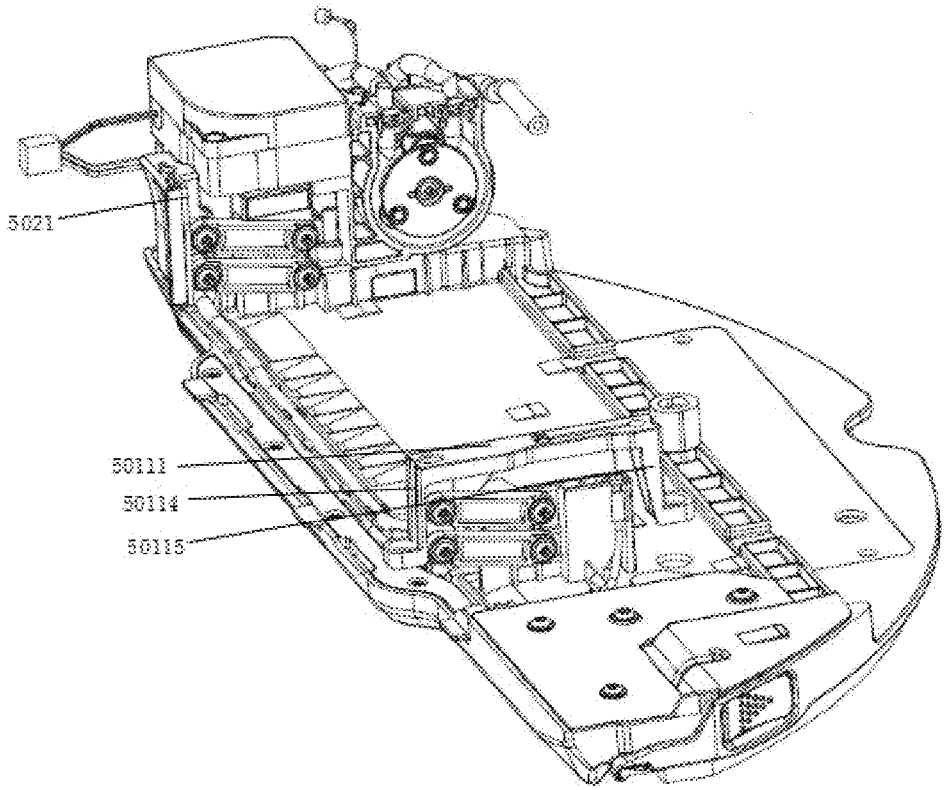
FIG. 18 is a schematic diagram of a four-link raising and lowering structure in a lowered state according to an embodiment of the present disclosure.

As shown in FIGS. 17 and 18, the four-link raising and lowering structure 500 includes: a first connecting end 501 for providing active power to switch the wet cleaning module 400 between the raised state and the lowered state; and a second connecting end 502 disposed opposite to the first connecting end 501 and rotating under the action of the active power. The first connecting end 501 and the second connecting end 502 are located on both sides of the wet cleaning module 400 respectively to raise or lower the wet cleaning module 400 by stably providing a raising or lowering force.

Specifically, the first connecting end 501 includes a first bracket 5011 fixedly connected to the bottom of the mobile platform 100. The first bracket 5011 is roughly shaped like a Chinese character "儿", and includes a cross beam 50111, a first longitudinal beam 50114 and a second longitudinal beam 50115, A tail end of each of the first longitudinal beam 50114 and the second longitudinal beam 50115 is fixedly connected to the mobile platform 100 through a bolt to provide a supporting force when the wet cleaning module 400 is raised and lowered.

The first connecting end 501 further includes a first connecting rod pair 5012, one end of the first connecting rod pair 5012 is rotatably connected to the first bracket 5011, and the other end of the first connecting rod pair 5012 is rotatably connected to the wet cleaning module 400. The first connecting rod pair 5012 may be of a hollowed-out structure, which can reduce an overall weight of raising and lowering ends.

Optionally, the first connecting rod pair 5012 includes a first connecting rod 50121 and a second connecting rod 50122 which are arranged in parallel, A first end of each of the first connecting rod 50121 and the second connecting rod 50122 is rotatably connected to the first longitudinal beam 50114 through a movable stud, and a second end of each of the first connecting rod 50121 and the second connecting rod 50122 is rotatably connected to the wet cleaning module 400 through a movable stud. For example, both ends of each of the first connecting rod 50121 and the second connecting rod 50122 are provided with a through hole having a diameter greater than that of the movable stud, respectively, so that the movable stud may rotate freely within the through hole, and is fixedly connected to the first longitudinal beam 50114 through the through hole. When the motor 4211 provides a pulling force to the first ends through the cable, the first ends of the first connecting rod 50121 and the second connecting rod 50122 simultaneously rotate around the movable studs at the first ends, and the second ends thereof are raised under the pulling force of the cable, so that the wet cleaning module 400 is raised. When the motor 4211 releases the pulling force to the first ends through the cable, the first ends of the first connecting rod 50121 and the second connecting rod 50122 simultaneously rotate reversely around the movable studs at the first ends, and the second ends thereof are lowered under the action of gravity, so that the wet cleaning module 400 is lowered.

The raising and lowering structure 500 further includes a cable 42194 for providing a pulling force to rotate the first connecting rod pair 5012 within a preset angle. The cable 42194 includes a cable motor terminal 50131 connected to the driving unit 420, for example, wound on the gear connected to the motor output shaft to extend and retract under the rotation of the motor; and a cable bracket terminal 50132 connected to the first bracket 5011. The motor raises or lowers the second ends of the first connecting rod 50121 and the second connecting rod 50122 through the cable 42194.

Optionally, the first bracket 5011 further includes: a slot 50112 extending along a surface of the cross beam 50111; and a snapping hole 50113 running through the cross beam 50111 and disposed at an extension end of the slot 50112 for accommodating and snapping the cable bracket terminal 50132. The cable 42194 is connected to the first ends of the first connecting rod 50121 and the second connecting rod 50122 through the slot 50112 and the snapping hole 50113. The slot 50112 can restrict a moving direction of the cable to ensure the stability of the raising and lowering module, and the width of the slot should match the thickness of the cable.

As shown in FIG. 17, the second connecting end 502 includes: a second bracket 5021 fixedly connected to the bottom of the mobile platform 100; and a second connecting rod pair 5022, one end of which is rotatably connected to the second bracket 5021, and the other end of which is rotatably connected to the wet cleaning module 400. The second connecting rod pair 5022 rotates along with the rotation of the first connecting rod pair 5012. The second connecting rod pair 5022 may be of a hollowed-out structure, which can reduce the overall weight of raising and lowering ends.

Specifically, the second connecting rod pair 5022 includes a third connecting rod 50221 and a fourth connecting rod 50222 which are arranged in parallel. A first end of each of the third connecting rod 50221 and the fourth connecting rod 50222 is rotatably connected to the second bracket 5021 through a movable stud, and a second end of each of the third connecting rod 50221 and the fourth connecting rod 50222 is rotatably connected to the wet cleaning module 400 through a movable stud. For example, both ends of each of the third connecting rod 50221 and the fourth connecting rod 50222 are provided with a through hole having a diameter greater than that of the movable stud, respectively, so that the movable stud may rotate freely within the through hole, and is fixedly connected to the second bracket 5021 and the wet cleaning module 400 through the through hole. When the first connecting end 501 rotates under the driving of the motor 4211, the first ends of the third connecting rod 50221 and the fourth connecting rod 50222 simultaneously rotate around the movable studs at the first ends, and the second ends of the third connecting rod 50221 and the fourth connecting rod 50222 simultaneously rotate around the movable studs at the second ends, so that the wet cleaning module 400 is raised. When the pulling force to the first connecting end 501 is released, the third connecting rod 50221 and the fourth connecting rod 50222 simultaneously rotate reversely around the movable studs and are lowered under the action of gravity, so that the wet cleaning module 400 is lowered.

Through the four-link raising and lowering structure disposed between the wet cleaning module and the mobile platform, the wet cleaning module may be raised and lowered relative to the mobile platform. When a ground mopping task is performed, the wet cleaning module is lowered to enable the wet cleaning module to be in contact with the ground; and when the ground mopping task is completed, the wet cleaning module is raised to separate the wet cleaning module from the ground, thereby avoiding the increased resistance due to the existence of the cleaning module when the cleaning apparatus moves freely on the surface to be cleaned.

In cooperation with a surface medium sensor and other sensors that can detect a surface type of the surface to be cleaned, the raising and lowering module enables the wet cleaning module to perform a cleaning operation according to different surfaces to be cleaned. For example, the raising and lowering module raises the wet cleaning module in case of a carpet surface, and lowers the wet cleaning module in case of a floor surface, a floor tile surface or the like so as to perform cleaning, Thus, a more comprehensive cleaning effect is achieved.

Usually, the automatic cleaning device has a generally small resistance when cleaning a smooth ground. However, when the automatic cleaning device cleans a carpet, especially a long-pile carpet, or a mat, clothes, etc., a chassis of the automatic cleaning device may be easily in contact with long wool on the carpet, which will increase the resistance to the travel of the automatic cleaning device. In addition, the automatic cleaning device including the wet cleaning module is further provided with a water tank, which will undoubtedly increase the resistance to the travel of the automatic cleaning device when filled with water. Under the action of such resistance, the automatic cleaning device may easily get stuck and hence is unable to move.

Figure 19:
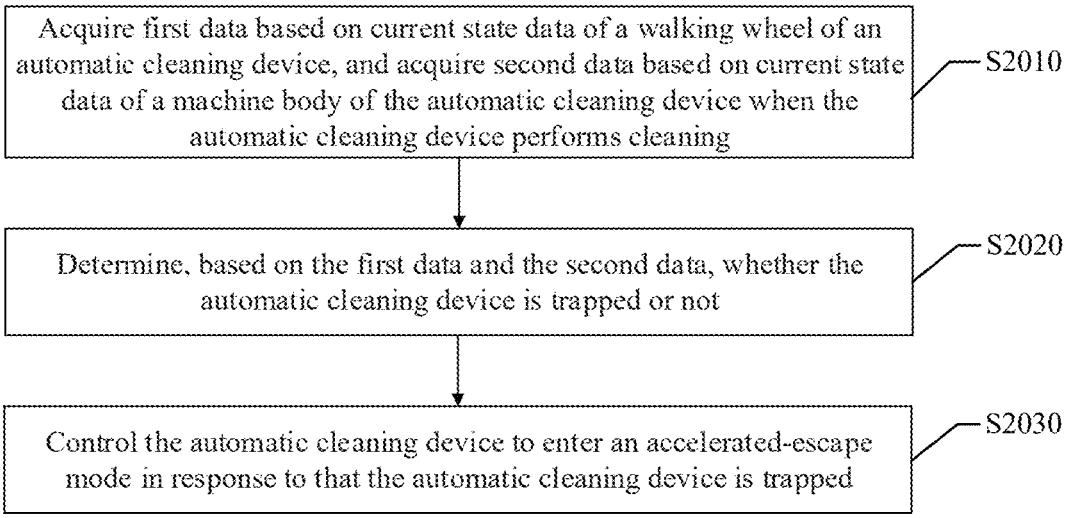
FIG. 19 is a flowchart of a method for controlling an automatic cleaning device according to an embodiment of the present disclosure.

Based on the above case, referring to FIG. 19, which is a flowchart of a method for controlling an automatic cleaning device according to an exemplary embodiment of the present disclosure, the method may specifically include the following steps.

In step S2020, first data based on current state data of a walking wheel of the automatic cleaning device and second data based on current state data of a machine body of the automatic cleaning device are acquired when the automatic cleaning device performs cleaning.

In step S2020, whether the automatic cleaning device is trapped or not is determined based on the first data and the second data.

In step S2030, the automatic cleaning device is controlled to enter an accelerated-escape mode if the automatic cleaning device is trapped.

In the method for controlling the automatic cleaning device according to the exemplary embodiment of the present disclosure, in the process that the automatic cleaning device performs the cleaning, it can be determined that the automatic cleaning device is trapped if the first data acquired based on the current state data of the walking wheel is different from the second data acquired based on the current state data of the machine body. At this time, the accelerated-escape mode may help the automatic cleaning device escape, so that the probability that the automatic cleaning device gets stuck is reduced.

The method for controlling the automatic cleaning device is not only used in the scene where the automatic cleaning device cleans surface medium areas such as a long-pile carpet, but also used in the scene where the automatic cleaning device crosses a doorsill or a small step or gets stuck by an obstacle. Any scene where the automatic cleaning device may escape by the method for controlling the automatic cleaning device according to the exemplary embodiment of the present disclosure falls within the protection scope of the exemplary embodiment of the present disclosure.

In an exemplary embodiment of the present disclosure, when the automatic cleaning device is trapped during cleaning and hence slips, the walking wheel of the automatic cleaning device may be idling generally. In this case, the first data acquired based on the current state data of the walking wheel is usually different from the second data acquired based on the current state data of the machine body. Therefore, whether the automatic cleaning device is trapped can be determined based on the difference between the first data and the second data.

The specific process of determining whether the automatic cleaning device is trapped or not is illustrated below in combination with different states.

In a first state, when the automatic cleaning device is in a rotating state, a theoretical angular velocity of the walking wheel is acquired as the first data based on the current state data of the walking wheel of the automatic cleaning device. Generally, the walking wheel may be idling in the case that the automatic cleaning device is trapped but does not stop. At this time, based on the state data of the walking wheel, a walking wheel sensor may acquire sensor data of the walking wheel such as a rotational speed of the walking wheel, and determine an angular velocity of the walking wheel based on the rotational speed of the walking wheel. For example, in the case that the rotational speed is n revolutions/minute, the angular velocity $\omega=n*2\pi/60$ radians/second. The angular velocity herein is called the theoretical angular velocity because it is acquired in the idling state of the walking wheel but not under the real situation.

Meanwhile, an actual angular velocity of the walking wheel may also be acquired as the second data based on the current state data of the machine body of the automatic cleaning device. The state data of the machine body is generally acquired by a state sensor on the machine body 1, so that the second data in a current state of the machine body may be acquired based on data of the state sensor on the automatic cleaning device. For example, the angular velocity actually generated by the walking wheel may be calculated based on the current state data of the machine body, measured by a gyroscope on the automatic cleaning device. The state sensor includes various sensors for measuring the state data, such as a gyroscope, a motor power sensor, a cliff sensor or a touch sensor.

Generally, the first data and the second data acquired above are the same under a non-slippery condition such as a hard ground. However, on a medium that may easily cause slipping, such as a long-pile carpet, the first data is usually greater than the second data due to the resistance of the medium.

In an exemplary embodiment of the present disclosure, it can be determined that the automatic cleaning device is trapped when the difference between the first data and the second data is greater than a first threshold and the difference being greater than the first threshold lasts for first preset time. At this time, it is required to control the automatic cleaning device to enter the accelerated-escape mode. The accelerated-escape mode may include controlling the automatic cleaning device to accelerate instantaneously after deceleration. In the case of instantaneous acceleration after deceleration, a static friction of the automatic cleaning device on the medium may be converted into slipping friction. Since the slipping friction is smaller than a maximum static friction, in the case that the automatic cleaning device is at the slipping friction, it is easier for the automatic cleaning device to escape, i.e., to get out of the current idling state, even if an accelerated velocity is the same as that in the case of static friction, so that the probability that the automatic cleaning device is capable of escaping can be increased, and the incidence of trapping of the automatic cleaning device is reduced.

In the exemplary embodiment of the present disclosure, the above-mentioned processes of detection, data calculation and instantaneous acceleration after deceleration are automatically completed by the automatic cleaning device, so that the probability of failure of the automatic cleaning device can be reduced, and the degree of automation of the automatic cleaning device can be improved, thereby improving the user experience.

In practice, the first threshold and the first preset time may be set according to actual situations. For example, the first threshold may be 2-10 radians/second, and the first preset time may be 3-6 seconds, etc., which is not particularly limited in the exemplary embodiments of the present disclosure.

In addition, by setting the first preset time, misjudgment caused when the automatic cleaning device crosses some smaller obstacles can be excluded.

In a second state, in the case that the automatic cleaning device slips in a straight forward movement state and hence is trapped, theoretical output power of a motor is acquired as the first data based on the current state data of the walking wheel of the automatic cleaning device. Usually, output power required for the automatic cleaning device to travel a certain distance on a carpet with higher resistance such as a long-pile carpet is generally lower than power actually output by the motor of the automatic cleaning device. That is, the output power of the motor, calculated based on the current travel distance of the walking wheel acquired by a walking wheel sensor, is theoretical output power of the motor, and is lower than the actual output power of the motor acquired based on the current state data of the machine body of the automatic cleaning device, i.e., the first data may be smaller than the second data.

In an exemplary embodiment of the present disclosure, if the difference between the first data and the second data is smaller than a second threshold and the difference being smaller than the second threshold lasts for second preset time, it is determined that the automatic cleaning device is trapped. At this time, it is required to control the automatic cleaning device to enter the accelerated-escape mode so as to help the automatic cleaning device escape. The specific situation of the accelerated-escape mode has been described in detail in the foregoing embodiments, and thus is not repeated herein.

In practice, the second threshold is a power value, and the magnitudes of the second threshold and the second preset time may be set according to actual situations. For example, the second threshold may be 5-10 W, and the second preset time may be 3-6 seconds, etc., which are not particularly limited in the exemplary embodiments of the present disclosure.

In a third state, in the case that the automatic cleaning device encounters an obstacle and is trapped in a backward movement state, for example, is trapped by long pile of the long-pile carpet and slips, similar to the case of slipping during forward movement in the second state, the theoretical output power of the motor may be acquired as the first data based on the current state data of the walking wheel of the automatic cleaning device; and the actual output power of the motor may be acquired as the second data based on the current state data of the machine body of the automatic cleaning device. In addition, the first data may be smaller than the second data.

When encountering an obstacle and thus moving backward, the automatic cleaning device usually needs to make continuous accelerated backward movements to avoid getting stuck, which means that there may be a misjudgment when whether the automatic cleaning device is trapped is determined only based on the magnitudes of the first data and the second data.

Therefore, in an exemplary embodiment of the present disclosure, electric current of a main brush of the automatic cleaning device is determined based on determining of the magnitudes of the first data and the second data. On a medium such as a long-pile carpet, the rotation of the main brush of the automatic cleaning device may also be subject to great resistance, resulting in an increase in the electric current. Therefore, by adding determination of the electric current of the main brush, the accuracy in determining whether the automatic cleaning device is trapped in the backward movement state can be improved, and the probability of misjudgment can be reduced.

In an exemplary embodiment of the present disclosure, if a difference between the first data and the second data is smaller than a third threshold and the difference being smaller than the third threshold lasts for third preset time, and electric current of a main brush of the automatic cleaning device exceeds a fourth threshold and the electric current exceeding the fourth threshold lasts for fourth preset time, it is determined that the automatic cleaning device is trapped.

In practice, the third threshold is a power value, and the third threshold and the third preset time may be set according to actual situations. For example, the third threshold may be 7-15 W, and the third preset time may be 3-6 seconds, etc. The fourth threshold is an electric current value, and the fourth threshold and the fourth preset time may be set according to actual situations. In addition, the fourth preset time may be equal to or longer than the third preset time, which is not particularly limited in the exemplary embodiments of the present disclosure.

In practice, the electric current of the main brush may also be increased in the case that a foreign matter enters the main brush of the automatic cleaning device, and the output power of the motor may also be increased when the automatic cleaning device passes a ridge or is in other scenes. Therefore, in order to reduce the misjudgment, made by the method for controlling the automatic cleaning device according to the exemplary embodiments of the present disclosure, as to whether the automatic cleaning device is trapped by the medium, as well as to reduce the probability that the automatic cleaning device enters the accelerated-escape mode, a step of excluding misjudgment is also added according to an exemplary embodiment of the present disclosure. This can reduce the probability of a dangerous situation that the automatic cleaning device rushes out a longer distance after instantaneous acceleration after deceleration, which is caused by the automatic cleaning device simply being trapped by the foreign matter on a short-pile carpet or other cases. Being trapped by the medium means that the automatic cleaning device is trapped by the medium such as a long-pile carpet and hence slips.

In an exemplary embodiment of the present disclosure, a result of instantaneous acceleration after deceleration may be calculated according to an accelerometer on the automatic cleaning device. For example, a change peak value of the accelerometer on the automatic cleaning device may be calculated. If the change peak value of the accelerometer on the automatic cleaning device exceeds a threshold, it means that the automatic cleaning device has a large acceleration and a large fluctuation, which reflects from an indirect perspective that the medium where the automatic cleaning device is located has small resistance and is not necessarily a medium such as a long-pile carpet. At this time, it can be determined that the automatic cleaning device is on a misjudgment-prone medium for which misjudgment is prone to occur. If it is determined that the automatic cleaning device is located on the misjudgment-prone medium, the accelerated-escape mode may be turned off when the automatic cleaning device is located on the misjudgment-prone medium to avoid a risk caused by misjudgment when the accelerated-escape mode is turned on, and also to prolong the service life of the automatic cleaning device.

In practice, the magnitude of the threshold may be set according to the performance of the automatic cleaning device, which is not particularly limited in the exemplary embodiments of the present disclosure.

Figure 20:
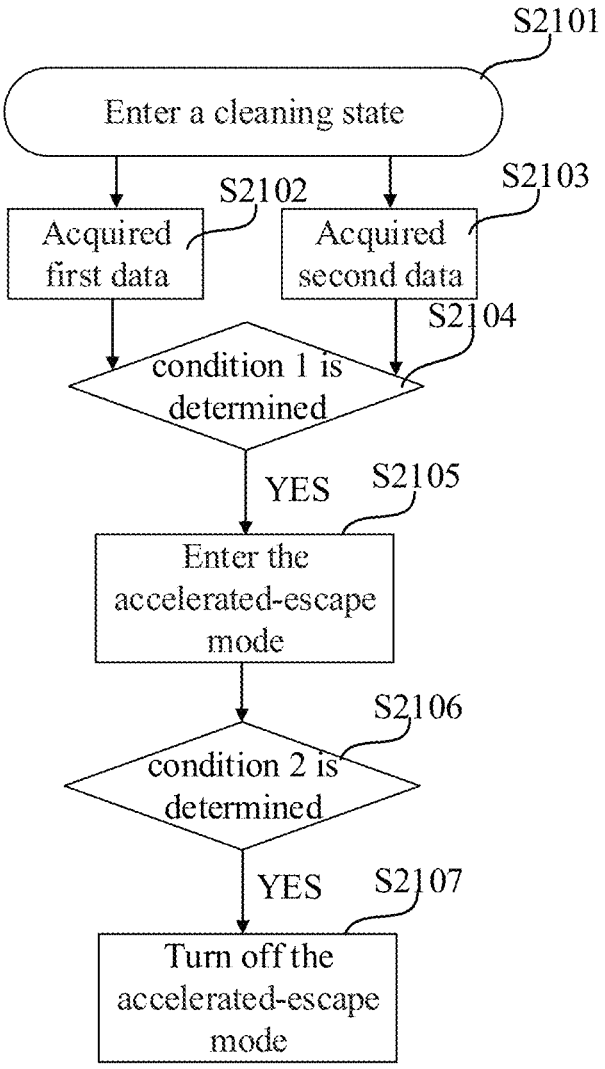
FIG. 20 is a flowchart of operation steps of a method for controlling an automatic cleaning device according to an embodiment of the present disclosure.

Referring to FIG. 20, which illustrates operation steps of a method for controlling an automatic cleaning device according to an exemplary embodiment of the present disclosure, the method may specifically include the following steps. In S2101, the automatic cleaning device enters a cleaning state. In S2102, first data is acquired based on current state data of a walking wheel of the automatic cleaning device. In S2103, second data is acquired based on current state data of a machine body of the automatic cleaning device. Next, in S2104, a condition 1 is determined, i.e., whether the automatic cleaning device is trapped or not is determined according to the first data and the second data; and if yes, i.e., the automatic cleaning device is trapped, S2105 is performed to control the automatic cleaning device to enter the accelerated-escape mode for performing escape. After S2105, S2106 may be performed to determine a condition 2, i.e., whether the misjudgment is caused by non-medium trapping is determined; and if yes, S2107 is performed to turn off the accelerated-escape mode.

In the method for controlling the automatic cleaning device according to an exemplary embodiment of the present disclosure, in the process that the automatic cleaning device performs the cleaning, whether the automatic cleaning device is trapped by a medium on which the automatic cleaning device is located is determined, and misjudgment caused by a non-medium is excluded, so that the accuracy of judgment is improved. Moreover, by setting different judgment criteria in different states, the accuracy in determining whether the automatic cleaning device is trapped can be further improved, the escaping efficiency of the automatic cleaning device can be improved, a risk aroused by misjudgment due to a non-medium can be avoided, and the service life of the automatic cleaning device can be prolonged.

In practice, the automatic cleaning device further includes other functions that help to achieve overall operation, which is not repeated in this exemplary embodiment.

It should be noted that although the individual steps of the method in the present disclosure are depicted in the accompanying drawings in a specific order, it is not required or implied that these steps must be performed in this specific order, or that all the steps shown must be performed to achieve the desired results. Additionally or alternatively, some steps may be omitted, multiple steps may be combined into one step for execution, and/or one step may be broken down into multiple steps for execution, etc.

Figure 21:
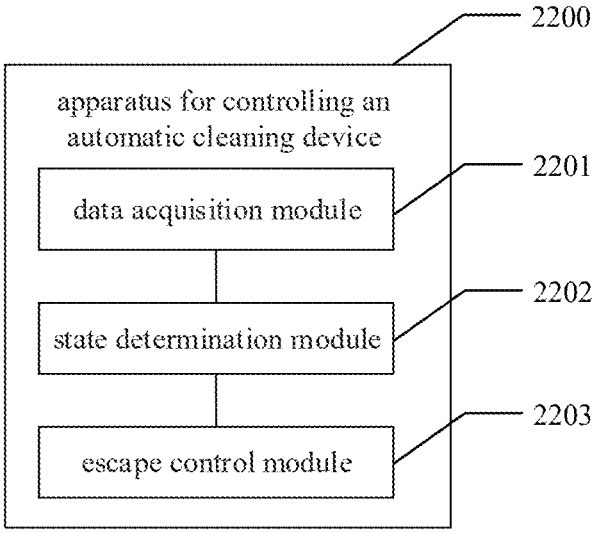
FIG. 21 is a block diagram of an apparatus for controlling an automatic cleaning device according to an embodiment of the present disclosure.

In an exemplary embodiment of the present disclosure, an apparatus for controlling an automatic cleaning device is further provided. As shown in FIG. 21, the apparatus 2200 for controlling the automatic cleaning device may include a data acquisition module 2201, a state determination module 2202, and an escape control module 2203.

The data acquisition module 2201 is configured to acquire first data based on current state data of a walking wheel of the automatic cleaning device and second data based on current state data of a machine body of the automatic cleaning device when the automatic cleaning device performs cleaning.

The state determination module 2202 is configured to determine, based on the first data and the second data, whether the automatic cleaning device is trapped or not.

The escape control module 2203 is configured to control the automatic cleaning device to enter an accelerated-escape mode if the automatic cleaning device is trapped.

The specific details of all the modules of the apparatus for controlling the automatic cleaning device are described in detail in the corresponding methods for controlling the automatic cleaning device, and thus will not be repeated herein.

It should be noted that although in the detailed descriptions above, a reference is made to a number of modules or units of the device for execution, the division is not mandatory. In fact, according to the embodiments of the present disclosure, the features, and functions of two or more modules or units described above may be embodied in one module or unit. Alternatively, the features and functions of one module or unit described above can be further divided and embodied by multiple modules or units.

In an exemplary embodiment of the present disclosure, an electronic device capable of implementing the methods described above is further provided.

It can be appreciated that various aspects of the present disclosure can be implemented as systems, methods, or program products. Therefore, various aspects of the present disclosure can be embodied in the following forms: an entirely hardware implementation, an entirely software implementation (including firmware, microcode, etc.), or an implementation combining hardware and software aspects, which can be collectively referred to as a "circuit", "module" or "system" herein.

An electronic device 2300 according to an embodiment of the present disclosure is described below with reference to FIG. 22. The electronic device 2300 shown in FIG. 22 is merely an example and should not be construed as constituting any limitations on the functionality or scope of use of embodiments of the present disclosure.

Figure 22:
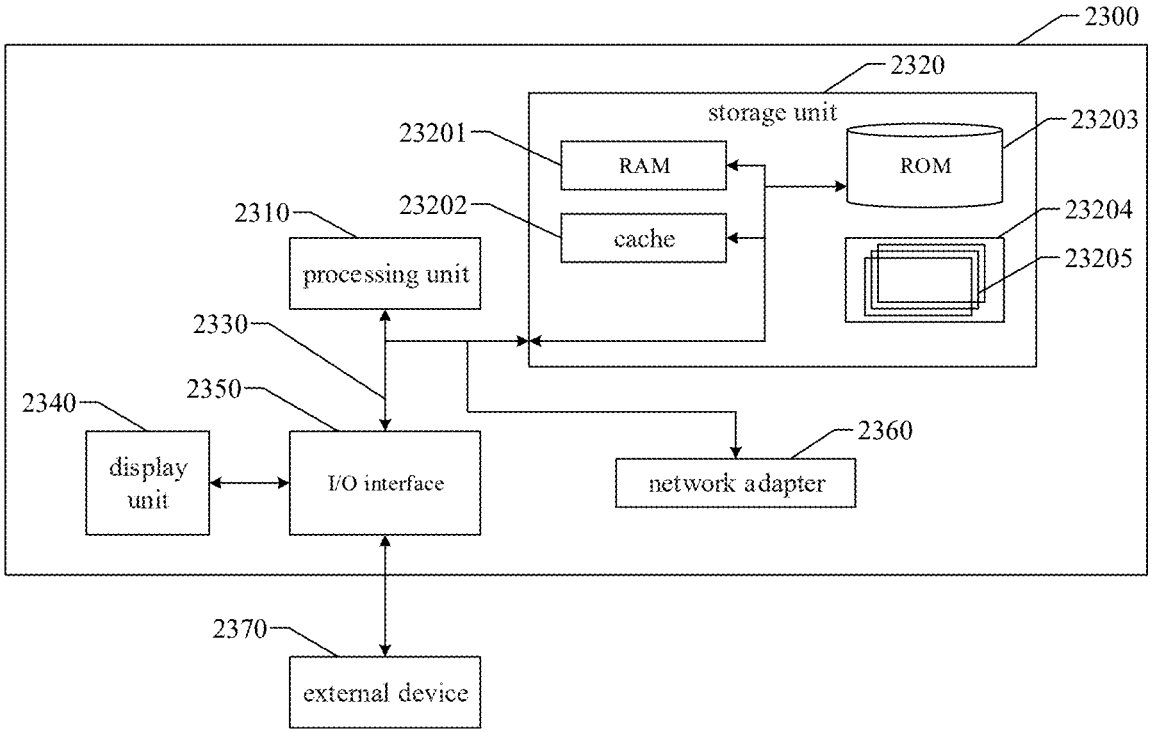
FIG. 22 is a schematic modular diagram of an electronic device according to an embodiment of the present disclosure.

As shown in FIG. 22, the electronic device 2300 is represented in the form of a general-purpose computing device. Components of the electronic device 2300 may include, but are not limited to, at least one processing unit 2310, at least one storage unit 2320, a bus 2330 connecting different system components including the storage unit 2320 and the processing unit 2310, and a display unit 2340.

The storage unit 2320 stores a program code executable by the processing unit 2310, so that the processing unit 2310 performs the steps according to various exemplary embodiments of the present disclosure described in the above-mentioned "exemplary method" section of the Description. For example, the processing unit 2310 may execute S2010, S2020 and S2030 as shown in FIG. 19, i.e., in S2010, acquiring first data based on current state data of a walking wheel of an automatic cleaning device, and acquiring second data based on current state data of a machine body of the automatic cleaning device when the automatic cleaning device performs cleaning; in S2020, determining, based on the first data and the second data, whether the automatic cleaning device is trapped or not; and in S2030, controlling the automatic cleaning device to enter an accelerated-escape mode in response to that the automatic cleaning device is trapped.

The storage unit 2320 may include a readable medium in the form of a volatile storage unit, such as a random access storage unit (RAM) 23201 and/or a cache storage unit 23202, and may further include a read-only storage unit (ROM) 23203.

The storage unit 2320 may further include a program/utility 23204 with a set of (at least one) program modules 23205, such program modules 23205 include, but are not limited to, an operating system, one or more application programs, other program modules and program data, and each or some combinations of these examples may include the implementation of a network environment.

The bus 2330 may represent one or more of several types of bus structures, including a storage unit bus or a storage unit controller, a peripheral bus, an accelerated graphics port, a processing unit, or a local bus using any of a variety of bus structures.

The electronic device 2300 may also communicate with at least one external device 2370 (such as a keyboard, a pointing device, a Bluetooth device, etc.), and may also communicate with at least one device that enable(s) a user to interact with the electronic device 2300, and/or the electronic device 2300 may communicate with any device (such as a router, a modem, etc.) that enables the electronic device 2300 to communicate with at least one other computing device. This communication may be performed via an input/output (I/O) interface 2350. In addition, the electronic device 2300 may also communicate with one or more networks (for example, a local area network (LAN), a wide area network, WAN) and/or a public network, such as the Internet) via a network adapter 2360. As shown in the figure, the network adapter 2360 communicates with other modules of the electronic device 2300 via the bus 2330. It should be understood that although not shown in the figure, other hardware and/or software modules may be used in conjunction with the electronic device 2300, including but not limited to: microcode, device drivers, redundant processing units, external disk drive arrays, redundant arrays of independent disks (RAID) systems, tape drives, and data backup storage systems.

For areas with different surface mediums, the automatic cleaning device needs to control the wet cleaning module to be raised and lowered according to the different surface mediums in the process of cleaning. For example, the wet cleaning module needs to be raised when a carpet surface is cleaned; the wet cleaning module needs to be lowered when a floor surface is cleaned; and the automatic cleaning device needs to control the wet cleaning module to be raised and lowered frequently when reciprocated cleaning is performed in a zigzag form, which may lead to a time-consuming cleaning process and shorten the service life of the automatic cleaning device.

Figure 23:
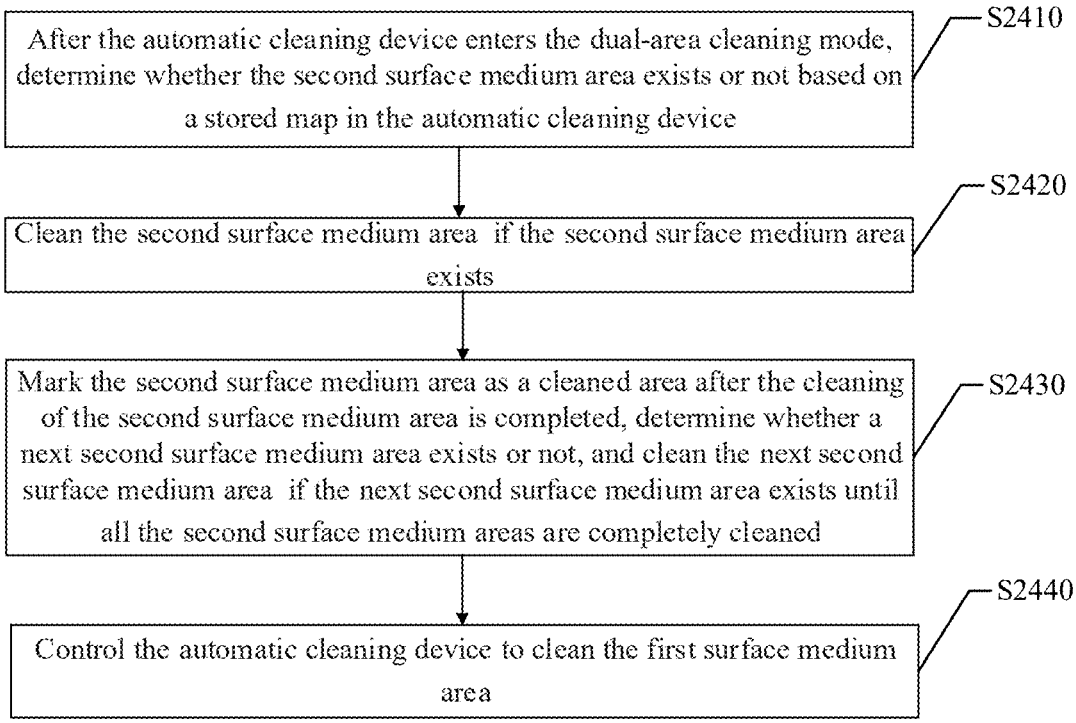
FIG. 23 is a flowchart of a cleaning method of an automatic cleaning device according to an embodiment of the present disclosure.

Accordingly, referring to FIG. 23, which is a flowchart of a cleaning method of an automatic cleaning device according to an exemplary embodiment of the present disclosure, the cleaning method of the automatic cleaning device may relate to a dual-area cleaning mode for cleaning a first surface medium area and a second surface medium area, and may specifically include the following steps.

In step S2410, after the automatic cleaning device enters the dual-area cleaning mode, whether the second surface medium area exists or not is determined based on a stored map in the automatic cleaning device.

In step S2420, the second surface medium area is cleaned if the second surface medium area exists.

In step S2430, the second surface medium area is marked as a cleaned area after the cleaning of the second surface medium area is completed, whether a next second surface medium area exists or not is determined, and the next second surface medium area is cleaned if the next second surface medium area exists until all the second surface medium areas are completely cleaned.

In step S2440, the automatic cleaning device is controlled to clean the first surface medium area.

In the cleaning method of the automatic cleaning device according to the exemplary embodiment of the present disclosure, the automatic cleaning device may be controlled to clean the second surface medium area first when the cleaning of the automatic cleaning device includes the cleaning of the first surface medium area and the second surface medium areas, and the first surface medium area is cleaned after all the second surface medium areas are completely cleaned, so that the number of times that the automatic cleaning device controls a wet cleaning module to raise and lower is reduced, the cleaning efficiency is improved and the service life of the automatic cleaning device is prolonged.

A first surface medium herein is one or more of floor surface mediums such as a wood floor, a tile or a cement surface. A second surface medium is one or more of floor surface mediums such as a carpet, which is(are) different from the first surface medium.

The whole process of the cleaning of an automatic cleaning device entering a room containing a dual-medium area is now described below with reference to the cleaning method of the automatic cleaning device according to an exemplary embodiment of the present disclosure.

First, upon entering the room, the automatic cleaning device first enters an along-wall cleaning mode, in which the automatic cleaning device may acquire a room map. It is required to compare the room map with a stored map if the automatic cleaning device contains the stored map. If the degree of matching between the two maps is higher, for example, the matching ratio is over 90%, the room is cleaned based on the stored map.

However, if the degree of matching is insufficient, for example, the matching ratio is below 90%, it is required to redraw the room map and draw the second surface medium area in the room.

Figure 24:
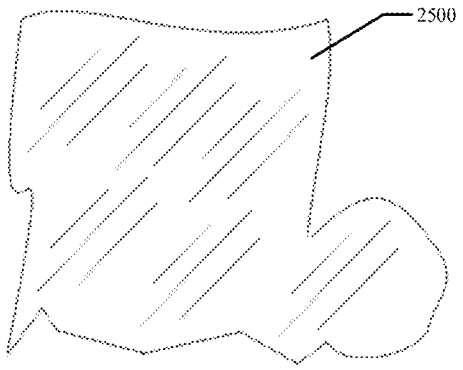
FIG. 24 is a schematic structural diagram of an initialization area after the second surface medium area is scanned according to an embodiment of the present disclosure.

In an exemplary embodiment of the present disclosure, a method for drawing the second surface medium area may include: scanning a boundary of the second surface medium area using a second surface medium area recognition apparatus, for example, scanning a boundary of a carpet area using a carpet recognition apparatus 103. After scanning, an initialization area 2500 as shown in FIG. 24 may be produced based on the scanned boundary, and the initialization area 2500 may be recorded in the automatic cleaning device.

Figure 25:
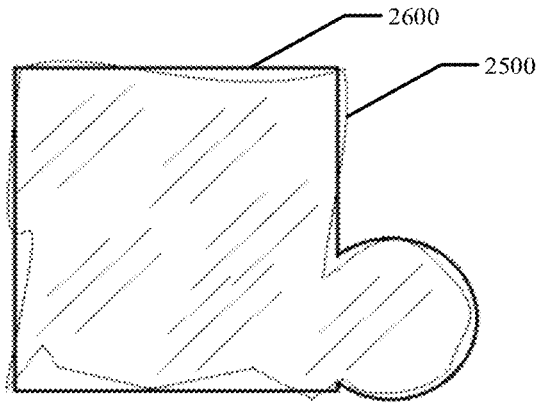
FIG. 25 is a schematic structural diagram of a merged area acquired based on the initialization area shown in FIG. 24.

Next, boundary coordinates of the initialization area 2500 may be merged, for example, the adjacent boundary coordinates may be merged into one coordinate to obtain a merged area 2600 as shown in FIG. 25, with the boundary smoother than that of the initialization area; and the stored map is updated using the merged area 2600 as a map of the second surface medium area, or a new room map is generated.

It should be noted that when the automatic cleaning device is controlled to enter the along-wall cleaning mode, if the automatic cleaning device detects the second surface medium area in the process of along-wall cleaning, the second surface medium area is ignored first, and the automatic cleaning device is controlled to continue with the along-wall cleaning until the along-wall cleaning is finished and the along-wall cleaning mode is exited. In addition, in the process of along-wall cleaning, the automatic cleaning device may also mark the detected second surface medium area and determine whether the second surface medium area exists in the stored map, and if not, the second surface medium area is stored in the stored map for reference during cleaning.

In an exemplary embodiment of the present disclosure, the automatic cleaning; device is controlled to enter the dual-area cleaning mode after the along-wall cleaning mode ends. After the automatic cleaning device enters the dual-area cleaning mode, whether the stored map has a second surface medium area or not may be determined according to the stored map in the automatic cleaning device. If the stored map has a second surface medium area, the automatic cleaning device is controlled to enter the position of the second surface medium area recorded in the stored map, and whether the second surface medium area still exists or not is detected; if yes, the automatic cleaning device is controlled to clean the second surface medium area; and if no, the second surface medium area is removed from the stored map to update the stored map.

Optionally, during cleaning of the second surface medium area by the automatic cleaning device, the automatic cleaning device may be controlled to clean a boundary area of the second surface medium area, i.e., an inner side of the boundary of the second surface medium area, within the second surface medium area, so as to delineate the second surface medium area. After the boundary area is cleaned, the automatic cleaning device is controlled to clean a remaining area of the second surface medium area within the delineated second surface medium area.

The automatic cleaning device may be controlled to clean in a zigzag manner (go straight-U turn-go straight-U turn) when cleaning the remaining area of the second surface medium area. Alternatively, other cleaning methods may be set according to actual situations, which is not particularly limited in the exemplary embodiment of the present disclosure.

Generally, there may be more than one second surface medium area in one room. At this time, the cleaned second surface medium area may be marked as a cleaned area after the cleaning of the second surface medium area is completed, and whether there is a next second surface medium area may be determined. If yes, the next second surface medium area may be cleaned until all the second surface medium areas in the room are completely cleaned. After that, the automatic cleaning device may be controlled to clean the first surface medium area.

During cleaning of the first surface medium area by the automatic cleaning device, an uncleaned second surface medium area may be detected. At this time, if an uncleaned second surface medium area exists, the automatic cleaning device is controlled to clean the uncleaned second surface medium area, and the uncleaned second surface medium area is stored in the stored map for next cleaning. After all the uncleaned second surface medium areas are completely cleaned, the automatic cleaning device is controlled to continue cleaning the first surface medium area until the first surface medium area is completely cleaned.

During cleaning of the first surface medium area, the automatic cleaning device may be Controlled, according to the first surface medium area delineated by the along-wall cleaning, to dean in a zigzag manner (i.e., go straight-U turn-go straight-U turn). Alternatively, other cleaning methods may be set according to actual situations, which is not particularly limited in the exemplary embodiment of the present disclosure.

In practice, during marking of the cleaned area, a coloring algorithm or other methods may be used to mark the cleaned area, which is not particularly limited in the exemplary embodiment of the present disclosure.

In an exemplary embodiment of the present disclosure, during cleaning of the second surface medium area, if the second surface medium area is a cross-block area, block limitation is ignored and a cleaning robot is controlled to clean the entire second surface medium area. Cross-block may mean crossing different rooms, i.e., the second surface medium area occupies part of areas of at least two rooms, so that limitation of two rooms may be ignored. The cleaning robot is first controlled to completely clean the entire second surface medium area, and the second surface medium area is marked as a cleaned area. The second surface medium area may not be cleaned any more in the later process of cleaning the two rooms.

In the method for cleaning the automatic cleaning device according to the exemplary embodiment of the present disclosure, by optionally cleaning the second surface medium area, for example, the second surface medium area such as a carpet may be cleaned in the case that the wet cleaning module is raised. Then, the wet cleaning module is lowered to clean the first surface medium area, i.e., the whole process of cleaning may be completed only by controlling the wet cleaning module to switch between raising and lowering once, which avoids frequent switching. Therefore, the cleaning efficiency is improved, and the service life of the automatic cleaning device is prolonged.

In practice, the automatic cleaning device also includes other functions that help to achieve overall operation, which is not repeated in this exemplary embodiment.

It should be noted that although the individual steps of the method in the present disclosure are depicted in the accompanying drawings in a specific order, it is not required or implied that these steps must be performed in this specific order, or that all the steps shown must be performed to achieve the desired results. Additionally or alternatively, some steps may be omitted, multiple steps may be combined into one step for execution, and/or one step may be broken down into multiple steps for execution, etc.

Figure 26:
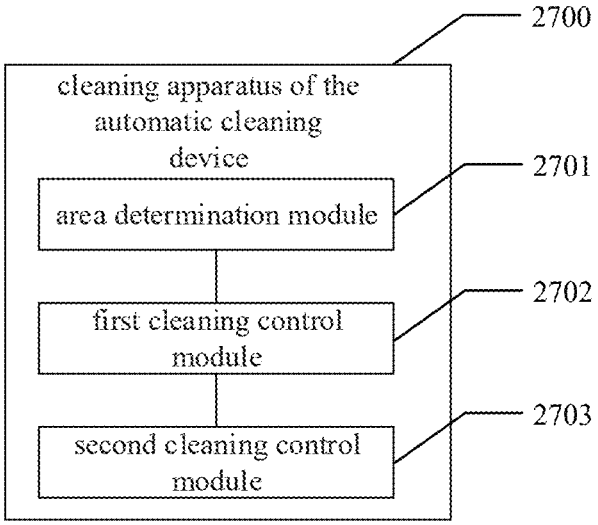
FIG. 26 is a block diagram of a cleaning apparatus of an automatic cleaning device according to an embodiment of the present disclosure.

In an exemplary embodiment of the present disclosure, a cleaning apparatus of an automatic cleaning device is further provided. The apparatus is arranged in the automatic cleaning device and used for cleaning in a dual-area cleaning mode including a first surface medium area and a second surface medium area. As shown in FIG. 26, the cleaning apparatus 2700 of the automatic cleaning device may include an area determination module 2701, a first cleaning control module 2702 and a second cleaning control module 2703.

The area determination module 2701 is configured to determine, after the automatic cleaning device enters the dual-area cleaning mode, whether the second surface medium area exists or not based on a stored map in the automatic cleaning device.

The first cleaning control module 2702 is configured to clean the second surface medium area if the second surface medium area exists, mark the second surface medium area as a cleaned area after the cleaning of the second surface medium area is completed, determine whether a next second surface medium area exists or not, and clean the next second surface medium area if the next second surface medium area exists until all the second surface medium areas are completely cleaned.

The second cleaning control module 2703 is configured to control the automatic cleaning device to clean the first surface medium area.

The specific details of all the modules of the cleaning apparatus of the automatic cleaning device are described in detail in the corresponding cleaning method of the automatic cleaning device, and thus will not be repeated herein.

It should be noted that although in the detailed descriptions above, a reference is made to a number of modules or units of the device for execution, the division is not mandatory. In fact, according to the embodiments of the present disclosure, the features and functions of two or more modules or units described above may be embodied in one module or unit. Alternatively, the features and functions of one module or unit described above can be further divided and embodied by multiple modules or units.

In an exemplary embodiment of the present disclosure, an electronic device capable of implementing the methods described above is further provided.

It can be appreciated that various aspects of the present disclosure can be implemented as systems, methods, or program products. Therefore, various aspects of the present disclosure can be embodied in the following forms: an entirely hardware implementation, an entirely software implementation (including firmware, microcode, etc.), or an implementation combining hardware and software aspects, which can be collectively referred to as a "circuit", "module" or "system" herein.

An electronic device 2800 according to an embodiment of the present disclosure is described below with reference to FIG. 27. The electronic device 2800 shown in FIG. 27 is merely an example and should not be construed as constituting any limitations on the functionality or scope of use of embodiments of the present disclosure.

Figure 27:
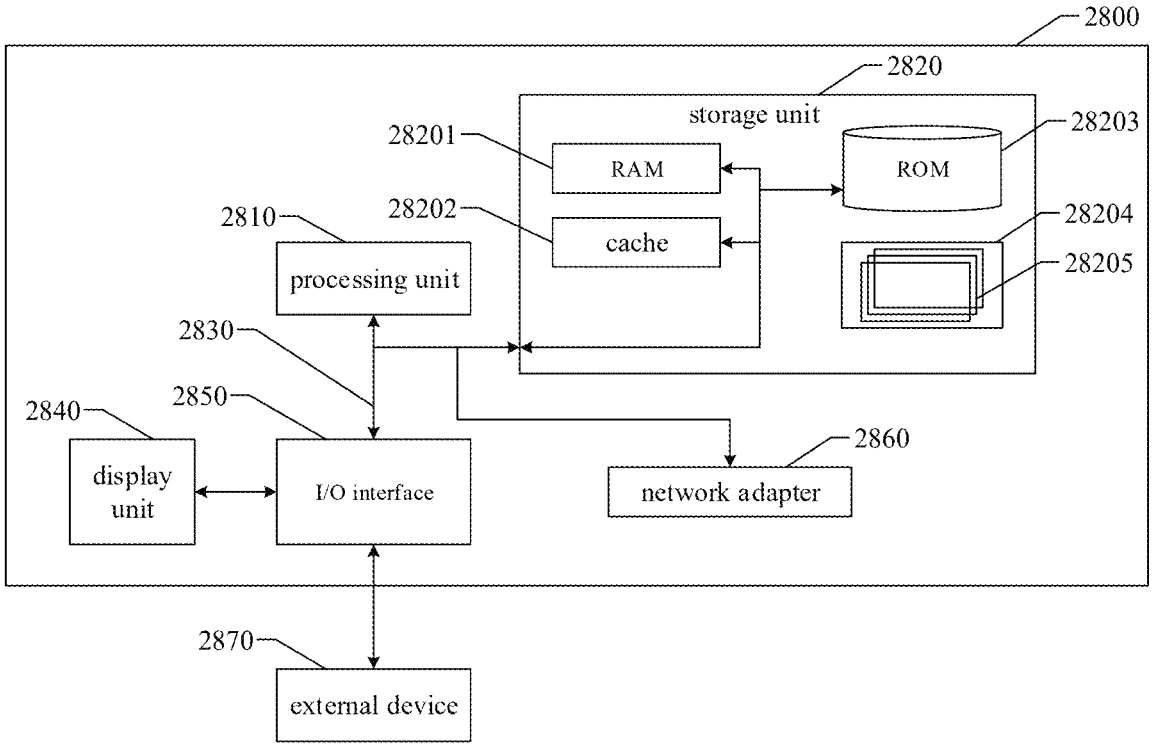
FIG. 27 is a schematic modular diagram of an electronic device according to an embodiment of the present disclosure.

As shown in FIG. 27, the electronic device 2800 is represented in the form of a general-purpose computing device. Components of the electronic device 2800 may include, but are not limited to, at least one processing unit 2810, at least one storage unit 2820, a bus 2830 connecting different system components including the storage unit 2820 and the processing unit 2810, and a display unit 2840.

The storage unit 2820 stores a program code executable by the processing unit 2810, so that the processing unit 2810 performs the steps according to various exemplary embodiments of the present disclosure described in the above-mentioned "exemplary method" section of the Description. For example, the processing unit 2810 may execute S2410, S2420, S2430 and S2440 as shown in FIG. 23, i.e., in S2410, after the automatic cleaning device enters a dual-area cleaning mode, determining whether a second surface medium area exists or not according to a stored map in the automatic cleaning device; in S2420, cleaning the second surface medium area if the second surface medium area exists; in S2430, marking the second surface medium area as a cleaned region after the cleaning of the second surface medium area is completed, and determining whether a next second surface medium area exits or not, and if yes, cleaning the next second surface medium area until all the second surface medium area are completely cleaned; and in S2440, controlling the automatic cleaning device to clean the first surface medium area.

The storage unit 2820 may include a readable medium in the form of a volatile storage unit, such as a random access storage unit (RAM) 28201 and/or a cache storage unit 28202, and may further include a read-only storage unit (ROM) 28203.

The storage unit 2820 may further include a program/utility 28204 with a set of (at least one) program modules 28205, such program modules 28205 include, but are not limited to, an operating system, one or more application programs, other program modules and program data, and each or some combinations of these examples may include the implementation of a network environment.

The bus 2830 may represent one or more of several types of bus structures, including a storage unit bus or a storage unit controller, a peripheral bus, an accelerated graphics port, a processing unit, or a local bus using any of a variety of bus structures.

The electronic device 2800 may also communicate with at least one external device 2870 (such as a keyboard, a pointing device and a Bluetooth device), and may also communicate with at least one device that enable(s) a user to interact with the electronic device 2800, and/or the electronic device 2800 may communicate with any device (such as a router and a modem) that enables the electronic device 2800 to communicate with at least one other computing device. This communication may be performed via an input/output WO) interface 2850. In addition, the electronic device 2800 may also communicate with at least one network (for example, a local area network (LAN), a wide area network, WAN) and/or a public network, such as the Internet) via a network adapter 2860. As shown in the figure, the network adapter 2860 communicates with other modules of the electronic device 2800 via the bus 2830. It should be understood that although not shown in the figure, other hardware and/or software modules may be used in conjunction with the electronic device 2800, including but not limited to: microcode, device drivers, redundant processing units, external disk drive arrays, and redundant arrays of independent disks (RAID) systems, tape drives, and data backup storage systems.

Through the descriptions of the above embodiments, it is understood that the exemplary embodiments described herein can be realized by software or a combination of software and necessary hardware. Therefore, the technical solutions according to the embodiments of the present disclosure can be embodied in the form of a software product. The software product can be stored in a non-volatile storage medium (a CD-ROM, a USB flash drive, a mobile hard disk, etc.) or on the network, and includes several instructions to cause a computing device (which may be a personal computer, a server, a terminal apparatus, a network device, or the like) to perform the methods according to the embodiments of the present disclosure.

In an exemplary embodiment of the present disclosure, a computer-readable storage medium is further provided, on which a program product capable of implementing the above-mentioned methods described herein is stored. In some possible embodiments, various aspects of the present disclosure can also be realized in the form of a program product, which includes a program code for causing a terminal device to perform the steps according to various exemplary embodiments of the present disclosure described in the above "exemplary method" section of the Description when the program product runs on the terminal device.

The program product for implementing the above methods according to the embodiments of the present disclosure may be a portable compact disc read-only: memory (CD-ROM), includes a program code, and may run on a terminal device, such as a personal computer. However, the program product according to the present disclosure is not limited thereto. In this document, the readable storage medium may be any tangible medium that includes or stores a program, and the program may be used by or in combination with an instruction execution system, apparatus, or device.

The program product may be any combination of one or more readable mediums. The readable medium may be a readable signal medium or a readable storage medium. The readable storage medium may be, for example, but is not limited to, an electrical, magnetic, optical, electromagnetic, infrared, or semiconductor system, apparatus, or device, or any combination thereof. More specific examples (non-exhaustive list) of the readable storage medium include: an electrical connection with one or more wires, a portable computer disk, a hard disk, a random-access memory (RAM), a read-only memory (ROM), an erasable programmable read-only memory (EPROM or flash memory), an optical fiber, a portable compact disk read-only memory (CD-ROM), an optical storage device, a magnetic storage device, or any suitable combination thereof.

The computer-readable signal medium may include a data signal propagated in a baseband or as a part of a carrier wave, which carries a readable program code. Such a propagated data signal may be in multiple forms, including but not limited to an electromagnetic signal, an optical signal, or any suitable combination thereof. The readable signal medium may further be any readable medium other than the readable storage medium, and the readable signal medium may send, propagate, or transmit a program that is used by or in combination with an instruction execution system, apparatus, or device.

The program code included in the readable medium may be transmitted by any suitable medium, including but not limited to a wireless manner, a wired manner, an optical cable, a radio frequency (RF), etc., or any suitable combination thereof.

The program code for performing the operations of the present disclosure may be written in one or more programming languages or a combination thereof. The programming languages include object-oriented programming languages such as Java, C++, and also include conventional procedural programming languages such as "C" or similar program design languages. The program code may be executed entirely on a user's computer, partially on a user's computer, executed as an independent software package, partially on a user's computer and partially executed on a remote computer, or entirely executed on a remote computer or server. In the case of a remote computer, the remote computer may be connected to a user's computer over any type of network, including a local area network (LAN) or a wide area network (WAN), or it may be connected to an external computer (for example, using an Internet service provider to connect over the Internet).

In addition, the above drawings are merely schematic illustrations of the processing included in the methods according to the exemplary embodiments of the present disclosure, and are not used for limiting purposes. It is easy to understand that the processing shown in the above figures do not indicate or limit the time sequence of these processing. In addition, it is also easy to understand that these processing can be performed synchronously or asynchronously in multiple modules, for example.

Other embodiments of the present disclosure will be apparent to those skilled in the art from consideration of the description and practice of the present disclosure. The present disclosure is intended to cover any variations, uses, or adaptations of the present disclosure following the general principles thereof and including common knowledge or commonly used technical measures which are not disclosed herein. The description and the embodiments are to be considered as exemplary only, with a true scope and spirit of the present disclosure defined by the claims.

It should be appreciated that the present disclosure is not limited to the exact construction that has been described above and illustrated in the accompanying drawings, and that various modifications and changes can be made without departing from the scope of the present disclosure. It is intended that the scope of the present disclosure is only defined by the appended claims.

What is claimed is:

1. A method for controlling an automatic cleaning device, comprising:

acquiring first data based on current state data of a walking wheel of the automatic cleaning device and second data based on current state data of a machine body of the automatic cleaning device when the automatic cleaning device performs cleaning;

determining, based on the first data and the second data, whether the automatic cleaning device is trapped or not; and controlling the automatic cleaning device to enter an accelerated-escape mode in response to that the automatic cleaning device is trapped;

wherein the method further comprises:

acquiring a theoretical angular velocity of the walking wheel as the first data based on the current state data of the walking wheel of the automatic cleaning device when the automatic cleaning device is in a rotating state;

acquiring an actual angular velocity of the walking wheel as the second data based on the current state data of the machine body of the automatic cleaning device; and in response to that a difference between the first data and the second data is larger than a first threshold and the difference being larger than the first threshold lasts for first preset time, determining that the automatic cleaning device is trapped;

or, wherein the method further comprises:

acquiring a theoretical output power of a motor as the first data based on the current state data of the walking wheel of the automatic cleaning device when the automatic cleaning device is in a straight forward movement state;

acquiring an actual output power of the motor as the second data based on the current state data of the machine body of the automatic cleaning device; and in response to that the difference between the first data and the second data is smaller than a second threshold and the difference being smaller than the second threshold lasts for second preset time, determining that the automatic cleaning device is trapped;

or, wherein the method further comprises:

acquiring the theoretical output power of the motor as the first data based on the current state data of the walking wheel of the automatic cleaning device when the automatic cleaning device encounters an obstacle and is in a backward movement state;

acquiring the actual output power of the motor as the second data based on the current state data of the machine body of the automatic cleaning device; and in response to that the difference between the first data and the second data is smaller than a third threshold and the difference being smaller than the third threshold lasts for third preset time, and electric current of a main brush of the automatic cleaning device exceeds a fourth threshold and the electric current exceeding the fourth threshold lasts for fourth preset time, determining that the automatic cleaning device is trapped.

2. The method for controlling the automatic cleaning device according to claim 1, wherein determining, based on the first data and the second data, whether the automatic cleaning device is trapped or not comprises:

determining, based on the difference between the first data and the second data, whether the automatic cleaning device is trapped or not.

3. The method for controlling the automatic cleaning device according to claim 1, wherein acquiring the theoretical output power of the motor based on the current state data of the walking wheel of the automatic cleaning device comprises:

determining the theoretical output power of the motor based on a current travel distance of the walking wheel of the automatic cleaning device.

4. The method for controlling the automatic cleaning device according to claim 1, wherein the accelerated-escape mode comprises controlling the automatic cleaning device to perform instantaneous acceleration after deceleration.

5. The method for controlling the automatic cleaning device according to claim 4, further comprising:

determining, based on a result of the instantaneous acceleration after deceleration, whether the automatic cleaning device is located on a misjudgment-prone medium for which a misjudgment is prone to occur; and turning off the accelerated-escape mode when the automatic cleaning device is located on the misjudgment-prone medium, in response to that it is determined that the automatic cleaning device is located on the misjudgment-prone medium.

6. The method for controlling the automatic cleaning device according to claim 5, wherein determining, based on the result of the instantaneous acceleration after deceleration, whether the automatic cleaning device is located on the misjudgment-prone medium comprises:

in response to that a change peak of an accelerometer on the automatic cleaning device exceeds a threshold after the instantaneous acceleration after deceleration, determining that the automatic cleaning device is located on the misjudgment-prone medium.

7. The method for controlling the automatic cleaning device according to claim 1 wherein acquiring the first data based on the current state data of the walking wheel of the automatic cleaning device comprises:

acquiring the first data in a current state of the walking wheel based on data of a walking wheel sensor of the automatic cleaning device.

8. The method for controlling the automatic cleaning device according to claim 1, further comprising:

acquiring the current state data of the machine body based on a state sensor on the automatic cleaning device.

9. The method for controlling the automatic cleaning device according to claim 8, wherein the state sensor comprises a gyroscope, a motor power sensor, a cliff sensor, or a touch sensor.

10. A non-transitory computer-readable storage medium storing program instructions executable by at least one hardware processor, when executed, direct the at least one hardware processor to:

acquire first data based on current state data of a walking wheel of an automatic cleaning device and second data based on current state data of a machine body of the automatic cleaning device when the automatic cleaning device performs cleaning;

determine, based on the first data and the second data, whether the automatic cleaning device is trapped or not; and control the automatic cleaning device to enter an accelerated-escape mode in response to that the automatic cleaning device is trapped;

wherein the at least one hardware processor is further directed to:

acquire a theoretical angular velocity of the walking wheel as the first data based on the current state data of the walking wheel of the automatic cleaning device when the automatic cleaning device is in a rotating state;

acquire an actual angular velocity of the walking wheel as the second data based on the current state data of the machine body of the automatic cleaning device; and in response to that a difference between the first data and the second data is larger than a first threshold and the difference being larger than the first threshold lasts for first preset time, determine that the automatic cleaning device is trapped;

or, wherein the at least one hardware processor is further directed to:

acquire a theoretical output power of a motor as the first data based on the current state data of the walking wheel of the automatic cleaning device when the automatic cleaning device is in a straight forward movement state;

acquire an actual output power of the motor as the second data based on the current state data of the machine body of the automatic cleaning device; and in response to that the difference between the first data and the second data is smaller than a second threshold and the difference being smaller than the second threshold lasts for second preset time, determine that the automatic cleaning device is trapped;

or, wherein the at least one hardware processor is further directed to:

acquire the theoretical output power of the motor as the first data based on the current state data of the walking wheel of the automatic cleaning device when the automatic cleaning device encounters an obstacle and is in a backward movement state;

acquire the actual output power of the motor as the second data based on the current state data of the machine body of the automatic cleaning device; and in response to that the difference between the first data and the second data is smaller than a third threshold and the difference being smaller than the third threshold lasts for third preset time, and electric current of a main brush of the automatic cleaning device exceeds a fourth threshold and the electric current exceeding the fourth threshold lasts for fourth preset time, determine that the automatic cleaning device is trapped.

11. An electronic device, comprising:

at least one hardware processor; and a memory configured to store program instructions executable by the at least one hardware processor, that, when executed, direct the at least one hardware processor to:

acquire first data based on current state data of a walking wheel of an automatic cleaning device and second data based on current state data of a machine body of the automatic cleaning device when the automatic cleaning device performs cleaning;

determine, based on the first data and the second data, whether the automatic cleaning device is trapped or not; and control the automatic cleaning device to enter an accelerated-escape mode in response to that the automatic cleaning device is trapped;

wherein the at least one hardware processor is further directed to:

acquire a theoretical angular velocity of the walking wheel as the first data based on the current state data of the walking wheel of the automatic cleaning device when the automatic cleaning device is in a rotating state;

acquire an actual angular velocity of the walking wheel as the second data based on the current state data of the machine body of the automatic cleaning device; and in response to that a difference between the first data and the second data is larger than a first threshold and the difference being larger than the first threshold lasts for first preset time, determine that the automatic cleaning device is trapped;

or, wherein the at least one hardware processor is further directed to:

acquire a theoretical output power of a motor as the first data based on the current state data of the walking wheel of the automatic cleaning device when the automatic cleaning device is in a straight forward movement state;

acquire an actual output power of the motor as the second data based on the current state data of the machine body of the automatic cleaning device; and in response to that the difference between the first data and the second data is smaller than a second threshold and the difference being smaller than the second threshold lasts for second preset time, determine that the automatic cleaning device is trapped;

or, wherein the at least one hardware processor is further directed to:

acquire the theoretical output power of the motor as the first data based on the current state data of the walking wheel of the automatic cleaning device when the automatic cleaning device encounters an obstacle and is in a backward movement state;

acquire the actual output power of the motor as the second data based on the current state data of the machine body of the automatic cleaning device; and in response to that the difference between the first data and the second data is smaller than a third threshold and the difference being smaller than the third threshold lasts for third preset time, and electric current of a main brush of the automatic cleaning device exceeds a fourth threshold and the electric current exceeding the fourth threshold lasts for fourth preset time, determine that the automatic cleaning device is trapped.

12. The electronic device according to claim 11, wherein the at least one hardware processor is further directed to: determine, based on a difference between the first data and the second data, whether the automatic cleaning device is trapped or not.

13. The electronic device according to claim 11, wherein the at least one hardware processor is further directed to:

determine the theoretical output power of the motor based on a current travel distance of the walking wheel of the automatic cleaning device.

14. The electronic device according to claim 11, wherein the accelerated-escape mode comprises controlling the automatic cleaning device to perform instantaneous acceleration after deceleration.

* * * * *